US011688337B2

(12) United States Patent
Harada et al.

(10) Patent No.: US 11,688,337 B2
(45) Date of Patent: Jun. 27, 2023

(54) DISPLAY DEVICE HAVING BOOTSTRAP CIRCUIT SUPPLIED WITH A PRECHARGE VOLTAGE

(71) Applicant: Japan Display Inc., Tokyo (JP)

(72) Inventors: Kenji Harada, Tokyo (JP); Tetsuo Morita, Tokyo (JP)

(73) Assignee: JAPAN DISPLAY INC., Tokyo (JP)

( * ) Notice: Subject to any disclaimer, the term of this patent is extended or adjusted under 35 U.S.C. 154(b) by 0 days.

(21) Appl. No.: 17/696,941

(22) Filed: Mar. 17, 2022

(65) Prior Publication Data

US 2022/0310003 A1 Sep. 29, 2022

(30) Foreign Application Priority Data

Mar. 29, 2021 (JP) ..... JP2021-055985

(51) Int. Cl.
*G09G 3/3208* (2016.01)

(52) U.S. Cl.
CPC ... *G09G 3/3208* (2013.01); *G09G 2300/0452* (2013.01); *G09G 2300/0842* (2013.01); *G09G 2310/08* (2013.01)

(58) Field of Classification Search
CPC ..... G09G 3/3208
USPC ..... 345/214
See application file for complete search history.

(56) References Cited

U.S. PATENT DOCUMENTS

2002/0158666 A1 10/2002 Azami et al.
2005/0243034 A1* 11/2005 Chung ..... G09G 3/3275 345/76
2019/0005881 A1* 1/2019 Yue ..... G09G 3/3241

FOREIGN PATENT DOCUMENTS

JP 4785271 B2 10/2011
JP 5712122 B2 5/2015

* cited by examiner

*Primary Examiner* — Long D Pham
(74) *Attorney, Agent, or Firm* — Xsensus LLP

(57) ABSTRACT

A bootstrap circuit includes a first transistor including a gate electrode, a first and a second electrodes, a capacitor connected between the gate electrode and the second electrode, and a second transistor connected to the gate electrode. In a first period, the second transistor is turned on and the gate electrode is supplied with a first analog voltage, the first transistor is turned on, and the second electrode is supplied with a precharge voltage smaller than the first analog voltage from the first electrode. In a second period, the second transistor is turned off, the first electrode is supplied with a second analog voltage, the capacitor supplies a third analog voltage to the gate electrode in response to the first analog voltage and the second analog voltage, and the second electrode is supplied with the second analog voltage from the first electrode.

12 Claims, 15 Drawing Sheets

DISPLAY DEVICE HAVING BOOTSTRAP CIRCUIT SUPPLIED WITH A PRECHARGE VOLTAGE

CROSS-REFERENCE TO RELATED APPLICATIONS

This application is based upon and claims the benefit of priority from the prior Japanese Patent Application No. 2021-055985 filed on Mar. 29, 2021, the entire contents of which are incorporated herein by reference.

FIELD

An embodiment of the present invention relates to a display device of a bootstrap circuit.

BACKGROUND

A display device, represented by an organic electroluminescent display device (hereinafter referred to as EL display device), is widely used as a display device for notebook computers, liquid crystal TVs, portable information terminals and the like. A display device includes, for example, an integrated circuit (IC), a plurality of analog switches, and a plurality of signal lines and a plurality of pixels, and a configuration for supplying an image signal including an analog voltage from an IC via the analog switch to a signal line connected to the analog switch and a pixel connected to the signal line. For example, a display device driven by a time-division control method can distribute an image signal including an analog voltage from an IC to a plurality of signal lines via an analog switch to control a plurality of pixels. In other words, in a display device driven by the time-division control method, one image signal line that provides an image signal is shared by a plurality of pixels, so that the number of parts when manufacturing the display device is small, and the manufacturing cost of a display device can be reduced.

In the case where an image signal including an analog voltage is supplied to a signal line via an analog switch, for example, there is a possibility that a voltage equivalent to the analog voltage is not supplied to the signal line. For example, Japanese Patent No. 4785271 and Japanese Patent No. 5712122 disclose a configuration using a bootstrap method for outputting a voltage equivalent to a voltage corresponding to an input digital signal. In the case where an image signal including an analog voltage is supplied to a signal line via an analog switch, in order to supply a voltage equivalent to the analog voltage to the signal line, a voltage range of a control signal that controls the on/off of the analog switch is wider than a voltage range of the image signal including the analog voltage. Consequently, there is a possibility that the drive voltage of the display device increases. In the case where the voltage range of the control signal that controls the on/off of the analog switch is wider than the voltage range of the image signal including the analog voltage, the load on the analog switch due to the voltage applied to the analog switch becomes large, and the characteristics of the analog switch tend to deteriorate. As a result, it becomes difficult for the analog switch to supply a voltage equal to the analog voltage to the signal line, which may deteriorate the display property of the display device.

SUMMARY

A bootstrap circuit display device according to an embodiment includes a first transistor including a gate electrode, a first electrode and a second electrode, a capacitor electrically connected between the gate electrode and the second electrode, and a second transistor electrically connected to the gate electrode. In a first period when the bootstrap circuit is driven, the second transistor is turned on and the gate electrode is supplied with a first analog voltage, the first transistor is turned on, and the second electrode is supplied with a precharge voltage smaller than the first analog voltage from the first electrode. In a second period when the bootstrap circuit is driven, the second transistor is turned off and the first electrode of the first transistor is supplied with a second analog voltage, the capacitor supplies a third analog voltage to the gate electrode in response to the first analog voltage and the second analog voltage, and the second electrode is supplied with the second analog voltage from the first electrode.

The display device according to an embodiment includes a plurality of pixels, a bootstrap circuit including a first transistor (switching transistor SW2) including a gate electrode, a first electrode and a second electrode, a capacitor electrically connected between the gate electrode and the second electrode and a second transistor (switching transistor SW1) electrically connected to the gate electrode, and a control circuit. The bootstrap circuit is configured to electrically connect the second electrode to one of the plurality of pixels. In a first period when the bootstrap circuit is driven, the control circuit supplies a first analog voltage to the second transistor, supplies a precharge voltage smaller than a first analog voltage to the first electrode, the second transistor is turned on, the gate electrode is supplied with the first analog voltage, the first transistor is turned on, the gate electrode is supplied with the first analog voltage, the second electrode is supplied with a precharge voltage smaller than the first analog voltage from the first electrode. In a second period after the first period when the bootstrap circuit is driven, the second transistor is turned off, the first electrode is supplied with a second analog voltage, the capacitor supplies a third analog voltage to the gate electrode in response to the first analog voltage and the second analog voltage, and the first transistor supplies the second analog voltage from the first electrode to the second electrode.

DESCRIPTION OF EMBODIMENTS

Hereinafter, an embodiment will be described with reference to the drawings and the like. However, the present disclosure can be implemented in many different modes, and should not be construed as being limited to the description of the following embodiments. For clarity of explanation, the drawings may be schematically represented with respect to configurations and the like of the respective parts compared with actual embodiments, but are merely an example and do not limit the interpretation of the present disclosure. Further, in this specification and each drawing, the same symbols (or symbols with a, b, A, B, etc. attached after numbers) are given to the same elements as those described above with reference to the preceding drawings, and detailed description thereof may be omitted as appropriate. The letters "first" and "second" attached to each element are convenient labels used to distinguish each element and have no further meaning unless otherwise stated.

The expressions "a includes A, B, or C", "a includes any of A, B, and C", and "a includes one selected from a group consisting of A, B, and C", unless otherwise specified, do not exclude the case where a includes multiple combinations of A to C. Furthermore, these expressions do not exclude the case where a includes other elements.

It is an object of the present disclosure to provide a structure which suppresses degradation of a display device.

A bootstrap circuit and a display device according to some embodiments described below include, for example, a configuration that applies a bootstrap method to a voltage supplied to a gate electrode of a switch transistor that controls an input of a signal including an analog voltage. A display device according to the embodiment shown below may be a liquid crystal display device and may be an EL display device.

1. First Embodiment

<1-1. Outline of Display Device 10>

An outline of a display device 10 will be described with reference to FIG. 1 to FIG. 3.

<1-1-1. Configuration of the Display Device 10>

Figure 1:
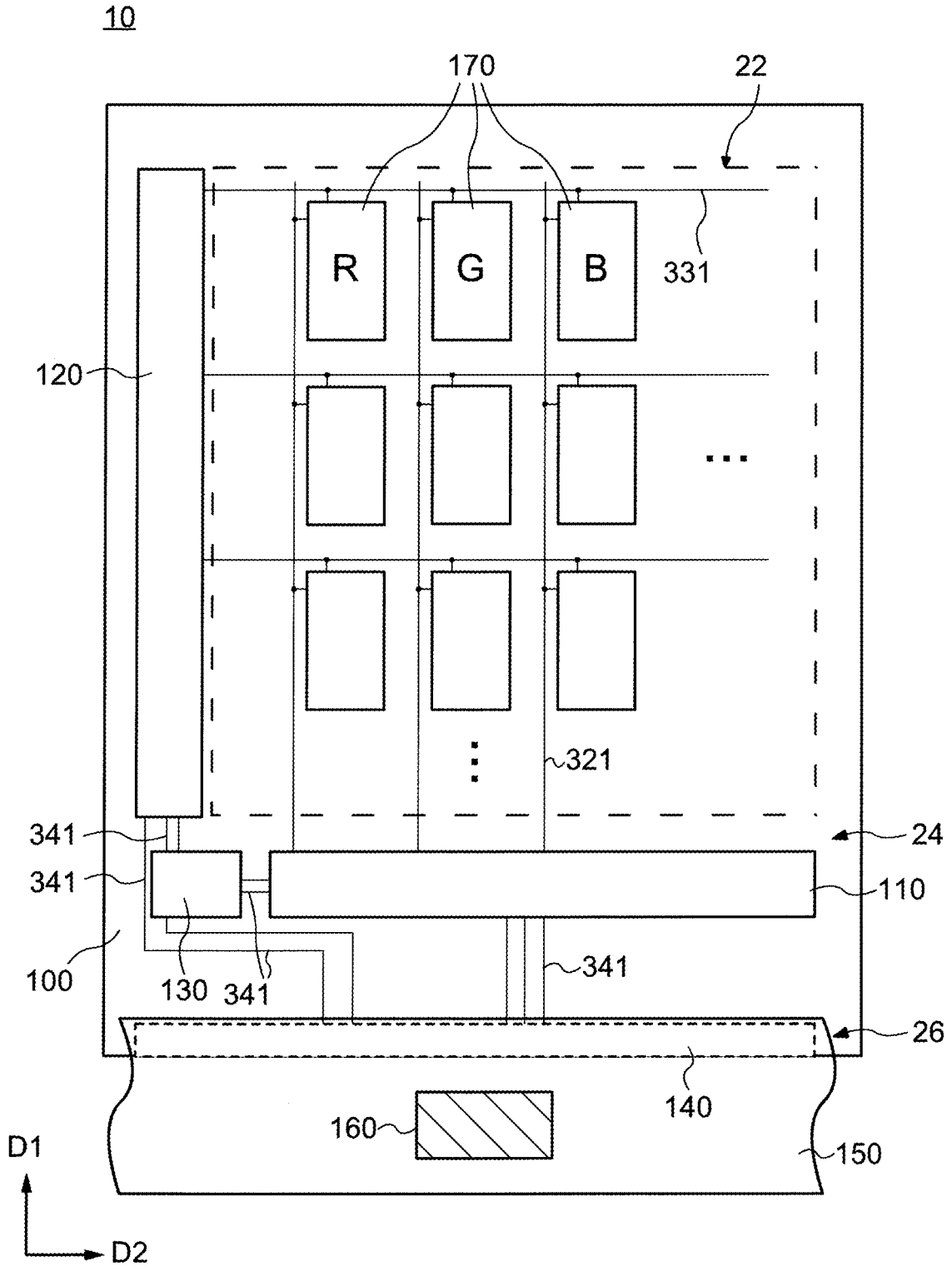
FIG. 1 is a schematic plan view showing a configuration of a display device according to an embodiment.

FIG. 1 is a schematic plan view showing a configuration of the display device 10. The configuration of the display device 10 shown in FIG. 1 is merely an example, and the configuration of the display device 10 is not limited to the configuration shown in FIG. 1.

As shown in FIG. 1, the display device 10 includes an array substrate 100, a flexible printed circuit substrate 150 (FPC 150), and an IC chip 160. The display device 10 includes a display area 22 provided on the array substrate 100, a peripheral area 24 surrounding the display area, and a terminal area 26. A plurality of pixels 170 is arranged in a matrix in the display area 22. For example, when the display device 10 is a liquid crystal display device, the array substrate 100 may be bonded to a counter substrate (not shown) using a seal (not shown). The seal is provided on the peripheral area 24, for example, to surround the display area 22.

The FPC 150 is provided in the terminal area 26. For example, when the display device 10 is a liquid crystal display device, the terminal area 26 is an area on the array substrate 100 exposed from the counter substrate, and is provided on the outside of the peripheral area 24. In first direction D1, the outside of the peripheral area 24 is the area opposite to the area where the display area 22 is provided with respect to the peripheral area 24. The IC chip 160 is provided, for example, on the FPC 150. The IC chip 160 supplies a signal, a voltage, or the like for driving each pixel 170.

A source driver circuit 110, a gate driver circuit 120, and a control circuit 130 are provided in the peripheral area 24. The source driver circuit 110 is provided at a position adjacent to the display area 22 in the first direction D1 (column direction). The gate driver circuit 120 is provided at a position adjacent to the display area 22 in second direction D2 (row direction).

The array of the plurality of pixels 170 is, for example, a stripe array. Each of the plurality of pixels 170 may correspond to, for example, a sub-pixel R, a sub-pixel G, and a sub-pixel B. One pixel may be formed by three sub-pixels. The pixel 170 is the smallest unit that forms a part of an image to be displayed on the display area 22. Each sub-pixel is equipped with one display element. The display element may be, for example, a liquid crystal element or a light-emitting element. For example, in the case where the display element is a liquid crystal element, the color corresponding to the sub-pixel is determined by the characteristics of the liquid crystal element or a color filter (not shown) provided on the sub-pixel.

In the stripe array, the sub-pixel R, the sub-pixel G, and the sub-pixel B can be configured to display images having different colors from each other. For example, each of the sub-pixel R, the sub-pixel G, and the sub-pixel B may be provided with a color filter layer that emits the three primary colors of red, green, and blue. Any voltage or current is supplied to each of the three sub-pixels, and the display device 10 can display an image. There is no limitation on the arrangement of the pixel 170, and the display device 10 according to an embodiment may employ an arrangement of pixels, such as a delta-array, a pentile-array, or the like.

An image signal line 321 extends from the source driver circuit 110 in a first direction D1 and is connected to the plurality of pixels 170 arranged in the first direction D1. A scanning signal line 331 extends from the gate driver circuit 120 in the second direction D2 and is connected to the plurality of pixels 170 arranged in the second direction D2. The control circuit 130 is connected to the source driver circuit 110 and the gate driver circuit 120 using a connection wiring 341. In an embodiment, the connection wiring 341 may be referred to as the connection wiring 341 independently, and a bundle of a plurality of connection wirings 341 may be referred to as the connection wiring 341.

A terminal part 140 is provided in the terminal area 26. The terminal part 140 connects to the source driver circuit 110, the gate driver circuit 120, and the control circuit 130 using the connection wiring 341. The FPC 150 is connected to an external device (not shown) at the outside of the display device 10. Therefore, the display device 10 is connected to an external device via the terminal part 140 connected to the FPC 150 and an FPC. A control signal and voltage from the external device is transmitted to the display device 10 via the terminal part 140 connected to the FPC 150 and the FPC. The display device 10 drives each pixel 170 provided in the display device 10 using the control signal and voltage received from the external device. As a result, the display device 10 can display images on the display area 22.

In an embodiment, the control circuit 130 may be referred to as a control circuit independently, the IC chip 160 alone may be referred to as a control circuit, and a circuit including the control circuit 130 and the IC chip 160 may be referred to as a control circuit.

<1-1-2. Configuration of Source Driver Circuit 110, Control Circuit 130, and IC Chip 160>

Figure 2:
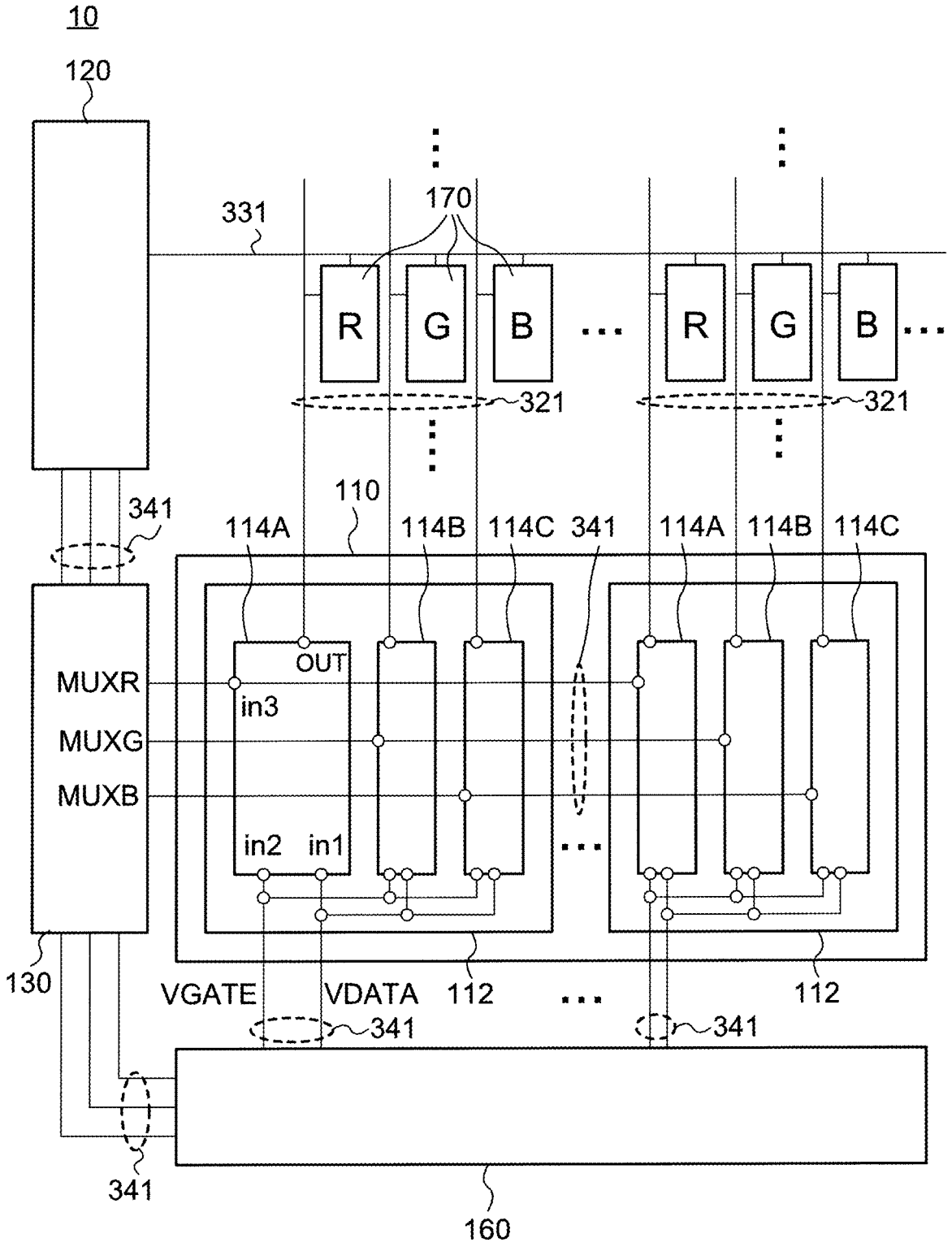
FIG. 2 is a schematic plan view showing a configuration of a display device according to an embodiment.

FIG. 2 is a schematic plan view showing a configuration of the display device 10. The configuration of the display device 10 shown in FIG. 2 is merely an example, and the configuration of the display device 10 is not limited to the configuration shown in FIG. 2. Description of the same or similar configurations as those in FIG. 1 is omitted here.

As shown in FIG. 2, the source driver circuit 110 includes a plurality of 3-selection multiplexer circuits 112. The 3-selection multiplexer circuit 112 includes three bootstrap circuits 114 (bootstrap circuit 114A, 114B, 114C). The 3-selection multiplexer circuit 112 is electrically connected to the control circuit 130 and the IC chip 160. In FIG. 2, for simplicity of explanation, illustrations such as the FPC 150, and the terminal part 140 are omitted.

The IC chip 160 is electrically connected to the source driver circuit 110 and the control circuit 130 using the connection wiring 341. The IC chip 160 uses the connection wiring 341 to transmit the control signal and voltage of the source driver circuit 110 to the source driver circuit 110 and transmits a control signal and voltage of the gate driver circuit 120, and a control signal and voltage of the source driver circuit 110 to the control circuit 130. For example, the IC chip 160 transmits a gate control signal VGATE and an image data signal VDATA to the source driver circuit 110. The control signal and voltage of the source driver circuit 110 includes the gate control signal VGATE and the image data signal VDATA.

The control circuit 130 is electrically connected to the source driver circuit 110 and the gate driver circuit 120 using the connection wiring 341. The control circuit 130 transmits the control signal and voltage of the gate driver circuit 120 received from the IC chip 160 to the gate driver circuit 120 using the connection wiring 341. The control circuit 130 transmits the control signal and voltage of the source driver circuit 110 received from the IC chip 160 to the source driver circuit 110 using the connection wiring 341. For example, the control circuit 130 transmits the control signal and voltage of the gate driver circuit 120 to the gate driver circuit 120 and transmits multiplexer signals MUXR, MUXG, and MUXB to the source driver circuit 110. The control signal and voltage of the source driver circuit 110 includes the multiplexer signals MUXR, MUXG, and MUXB.

The control circuit 130 may, for example, provide a plurality of control signals and a plurality of voltages to the source driver circuit 110 and the gate driver circuit 120. The control circuit 130 includes, for example, a logic circuit (not shown) and a voltage generation circuit (not shown). The control circuit 130 may use the logic circuit and voltage generation circuit to generate a new signal and power supply voltage from a plurality of control signals and voltages or the like, and provide the new signal and power supply voltage to the source driver circuit 110 and the gate driver circuit 120.

The bootstrap circuit 114 receives the multiplexer signal MUX, the gate control signal VGATE, and the image data signal VDATA. The bootstrap circuit 114 uses the multiplexer signal MUX, the gate control signal VGATE, and the image data signal VDATA to transmit the image signal to the sub-pixel. The image data signal VDATA is input to an input terminal in1 of the bootstrap circuit 114 via the connection wiring 341. The gate control signal VGATE is input to an input terminal in2 of the bootstrap circuit 114 via the connection wiring 341. The multiplexer signal MUX is input to an input terminal in3 of the bootstrap circuit 114 via the connection wiring 341. The image signal is output from an output terminal out of the bootstrap circuit 114 via the image signal line 321 and is transmitted to the pixel 170 electrically connected to the image signal line 321.

Specifically, the bootstrap circuit 114A receives the multiplexer signal MUXR, the gate control signal VGATE, and the image data signal VDATA. The bootstrap circuit 114A uses the multiplexer signal MUXR, the gate control signal VGATE, and the image data signal VDATA to transmit the image signal to the sub-pixel R. The bootstrap circuit 114B receives the multiplexer signal MUXG, the gate control signal VGATE, and the image data signal VDATA. The bootstrap circuit 114B uses the multiplexer signal MUXG, the gate control signal VGATE, and the image data signal VDATA to transmit the image signal to the sub-pixel G. The bootstrap circuit 114C receives the multiplexer signal MUXB, the gate control signal VGATE, and the image data signal VDATA. The bootstrap circuit 114C uses the multiplexer signal MUXB, the gate control signal VGATE, and the image data signal VDATA to transmit the image signal to the sub-pixel B. In an embodiment, the input terminal in1 may be referred to as a first input terminal, the input terminal in2 may be referred to as a second input terminal, and the input terminal in3 may be referred to as a third input terminal.

<1-1-3. Configuration of Bootstrap Circuit 114>

Figure 3:
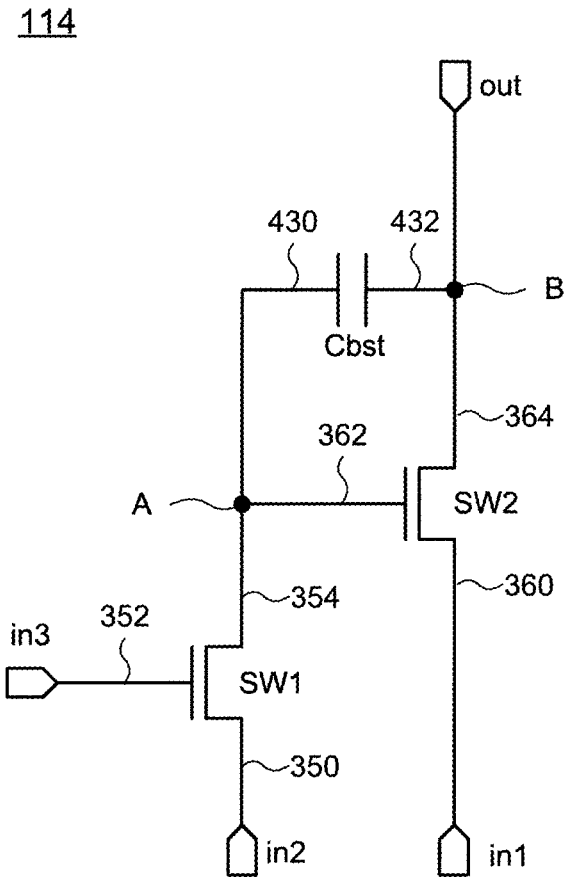
FIG. 3 is a circuit diagram showing a circuit configuration of a bootstrap circuit according to an embodiment.

FIG. 3 is a circuit diagram showing a circuit configuration of the bootstrap circuit 114. The configuration of the bootstrap circuit 114 shown in FIG. 3 is merely an example, and the configuration of the bootstrap circuit 114 is not limited to the configuration shown in FIG. 3. The same or similar configurations as those in FIG. 1 and FIG. 2 will not be described here.

As shown in FIG. 3, the bootstrap circuit 114 includes a switching transistor SW1 (second transistor), a switching transistor SW2 (first transistor), and a bootstrap capacitance Cbst. A first electrode 350 of the switching transistor SW1 is electrically connected to the input terminal in2. A gate electrode 352 of the switching transistor SW1 is electrically connected to the input terminal in3. A second electrode 354 of the switching transistor SW1 is electrically connected to node A, a gate electrode 362 of the switching transistor SW2, and a first electrode 430 of the bootstrap capacitance Cbst. A first electrode 360 of the switching transistor SW2 is electrically connected to the input terminal in1. A second electrode 364 of the switching transistor SW2 is electrically connected to node B, a second electrode 432 of the bootstrap capacitance Cbst, and the output terminal out.

The switching transistor SW1 and the switching transistor SW2 contain an oxide (oxide semiconductor) that exhibits semiconductor characteristics in a channel area. The oxide semiconductor includes an oxide containing a Group 13 element such as indium or gallium. Materials forming the oxide semiconductor include, for example, a mixed oxide of indium and gallium (IGO), or a mixed oxide containing indium, gallium, and zinc (IGZO). The oxide semiconductor may include tin, titanium, zirconium, and the like. The switching transistors SW1 and SW2 may contain a Group 14 element such as silicon and germanium in the channel area. For example, the channel area of each transistor may contain a low-temperature polysilicon (LTPS). In the display device 10 according to an embodiment, each transistor is formed using a thin film transistor (TFT) using an oxide semiconductor and is an n-channel field-effect transistor. The display device 10 may appropriately adapt the configuration of the transistor, storage capacitor connection, power supply voltage, and the like depending on the application and specifications.

The switching transistor SW1 has a first semiconductor film on the channel area. The switching transistor SW2 has a second semiconductor film on the channel area. The first semiconductor film and the second semiconductor film may be formed using the same material or may be formed using different materials. For example, the first semiconductor film and the second semiconductor film may be formed using an oxide semiconductor, or may be formed using a low-temperature polysilicon. One semiconductor film of the first semiconductor film and the second semiconductor film may be formed using an oxide semiconductor and the other semiconductor film may be formed using a low-temperature polysilicon.

<1-2. Driving Method of Display Device 10>

Figure 4:
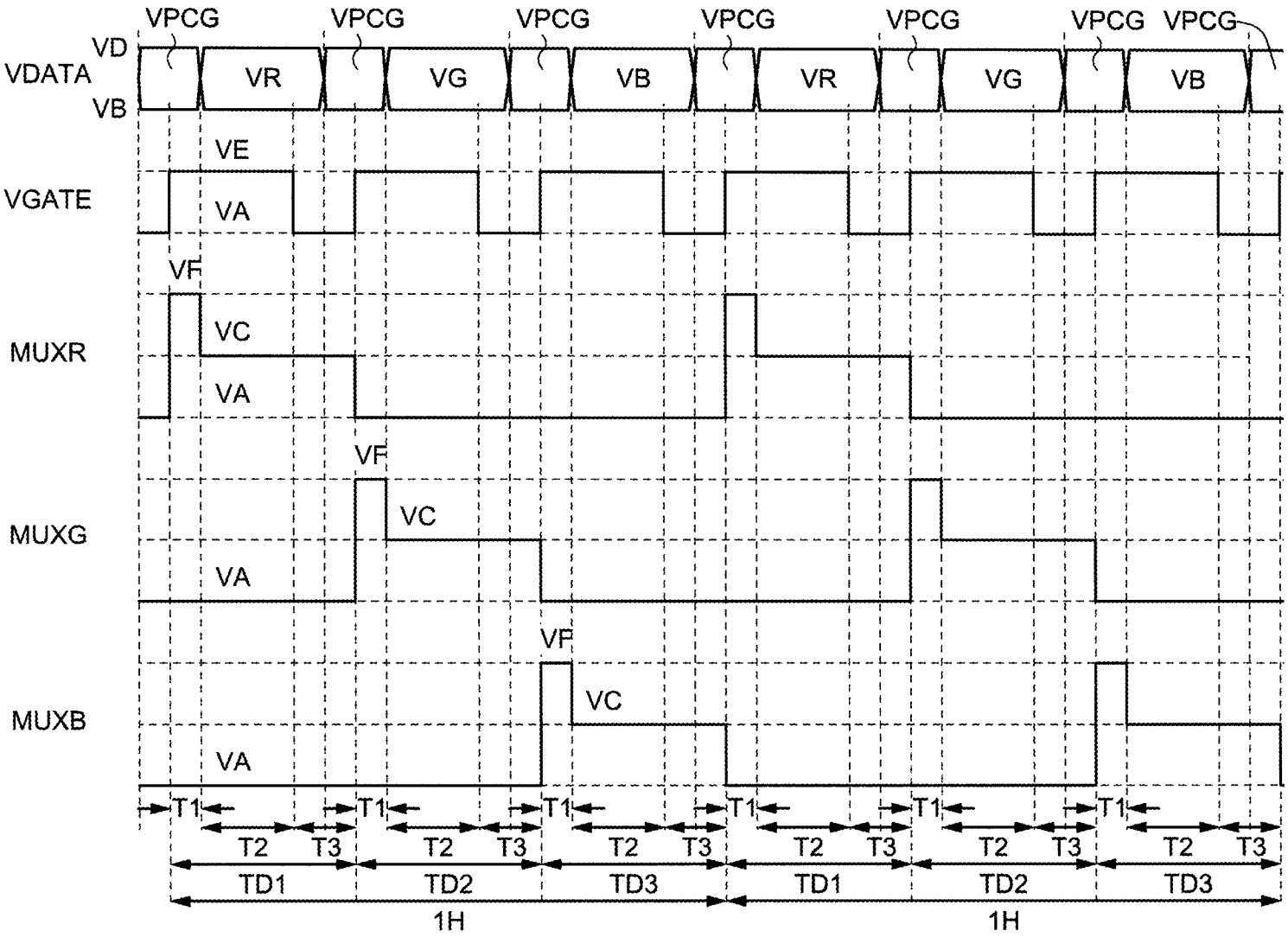
FIG. 4 is a timing chart showing a drive method of a display device according to an embodiment.
Figure 5:
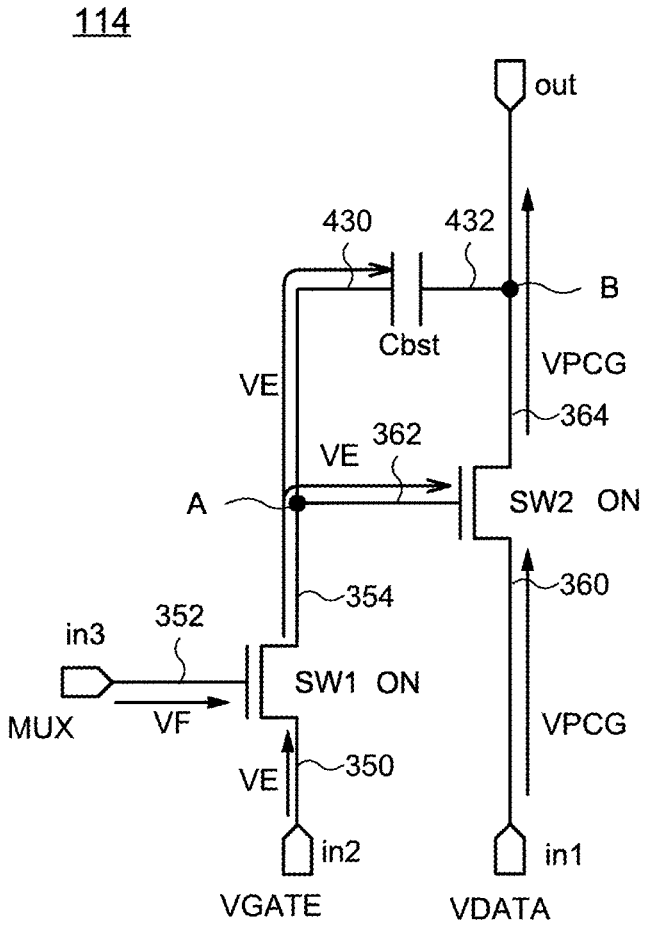
FIG. 5 is a schematic diagram showing an operating state of a bootstrap circuit at the timing shown in FIG. 4.
Figure 6:
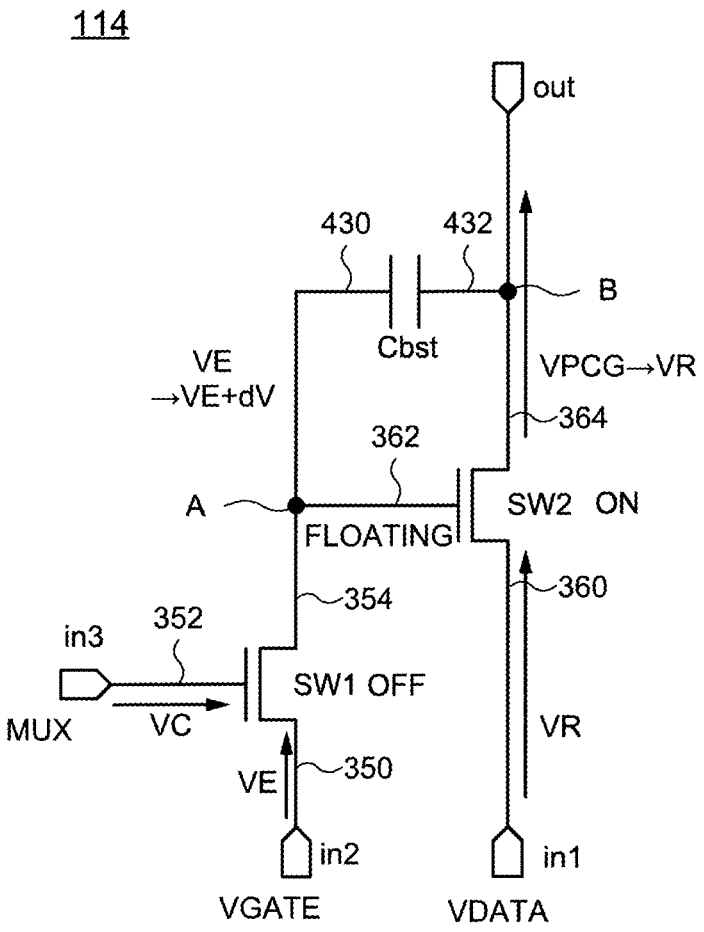
FIG. 6 is a schematic diagram showing an operating state of a bootstrap circuit at the timing shown in FIG. 4.
Figure 7:
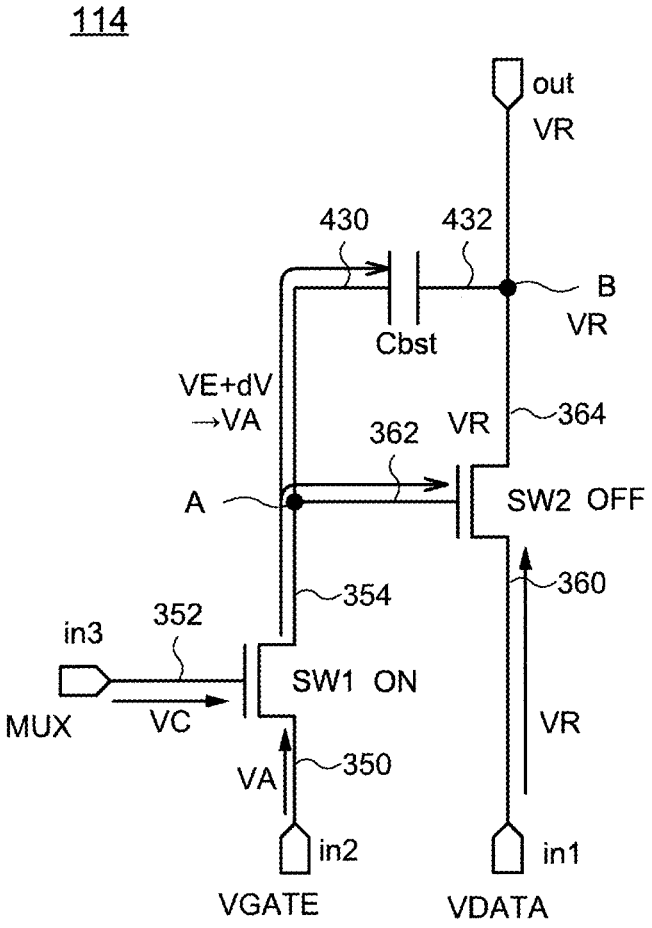
FIG. 7 is a schematic diagram showing an operating state of a bootstrap circuit at the timing shown in FIG. 4.

A driving method of the display device 10 will be described with reference to FIG. 4 to FIG. 7. FIG. 4 is a timing chart showing a driving method of the display device 10. Specifically, FIG. 4 is a timing chart showing an operation of the bootstrap circuit 114. FIG. 5 to FIG. 7 are schematic diagrams showing an operating state of the bootstrap circuit 114 at the timing shown in FIG. 4. The driving method of the display device 10 (bootstrap circuit 114) and the operation state of the bootstrap circuit 114 shown in FIG. 4 to FIG. 7 are merely examples, and the driving method of the display device 10 (bootstrap circuit 114) and the operation state of the bootstrap circuit 114 are not limited to the configurations shown in FIG. 4 to FIG. 7. The same or similar configurations as those in FIG. 1 to FIG. 3 will not be described here.

As shown in FIG. 4, in the driving method of the display device 10, one horizontal period (1H) is divided into three time-division periods, i.e., a first time-division period TD1, a second time-division period TD2, and a third time-division period TD3. In each period, image signals of different colors are transmitted. The respective periods of the first time-division period TD1, the second time-division period TD2, and the third time-division period TD3 include a first period, a second period, and a third period. The image of one screen is switched, for example, every one frame period (1 F).

As described above, the 3-selection multiplexer circuit 112 includes the bootstrap circuit 114A, the bootstrap circuit 114B, and the bootstrap circuit 114C. The display device 10 uses a time-division driving method to cause the bootstrap circuit 114A to be operated in the first time-division period TD1, and the bootstrap circuit 114A transmits the image signal to the sub-pixel R. The display device 10 uses a time-division driving method to cause the bootstrap circuit 114B to be operated in the second time-division period TD2, and the bootstrap circuit 114B transmits the image signal to the sub-pixel G. The display device 10 uses a time-division driving method to cause the bootstrap circuit 114C to be operated in the third time-division period TD3, and the bootstrap circuit 114C transmits the image signal to the sub-pixel B. That is, the display device 10 uses the time-division driving method to cause the bootstrap circuit 114A, the bootstrap circuit 114B, and the bootstrap circuit 114C to be operated at different timings from each other, and at the same timing, to transmit the image signal to the sub-pixels displaying the same color.

The driving method of the display device 10 is merely an example, and is not limited to the driving method described herein. For example, in the driving method of the display device 10, the bootstrap circuit 114A is operated in the second time-division period TD2, the bootstrap circuit 114B is operated in the third time-division period TD3, and the bootstrap circuit 114C is operated in the first time-division period TD1. The display device 10 may be adapted to the driving method depending on the application and specifications.

As shown in FIG. 4, in each time-division period TD, the bootstrap circuit 114 is similarly controlled. In the following explanation, the driving method in the first time-division period TD1 is mainly explained, and the explanations of the driving method in the second time-division period TD2 and the third time-division period TD3 are omitted.

<1-2-1. First Period T1>

The driving of the display device 10 in the first period T1 will be described with reference to FIG. 4 and FIG. 5. The first period T1 is a period for supplying a voltage VE (first analog voltage) to the node A, the gate electrode 362 of the second switching transistor SW2, and the first electrode 430 of the bootstrap capacitance Cbst, via the first switching transistor SW1. The first period T1 is a period for supplying a precharge voltage VPCG (precharge voltage) to the node B, an output electrode out of the bootstrap circuit 114A, the image signal line 321 electrically connected to the output terminal out, and the sub-pixel R electrically connected to the image signal line 321, via the second switching transistor SW2.

As shown in FIG. 4 or FIG. 5, the image data signal VDATA is transmitted from the IC chip 160 (FIG. 2) to the first electrode 360 of the second switching transistor SW2 via the input terminal in1 of the bootstrap circuit 114A. The image data signal VDATA is a signal including the precharge voltage VPCG which is an analog voltage. The precharge voltage VPCG is, for example, 2 V. In an embodiment, the extent of the analog voltage supplied from the IC chip 160 (FIG. 2) to the input terminal in1 is, for example, 0 V to 4 V.

The gate control signal VGATE is transmitted from the IC chip 160 (FIG. 2) to the first electrode 350 of the first switching transistor SW1 via the input terminal in2 of the bootstrap circuit 114A. The gate control signal VGATE is supplied with the voltage VE which is an analog voltage from a voltage VA. The voltage VA is a low voltage of each signal (Low voltage, Lo voltage), for example, −2 V. The voltage VE is a high voltage (High voltage, Hi voltage) of each signal, for example, 5 V.

The Voltage VE is a voltage larger than the precharge voltage VPCG by at least a threshold voltage Vthsw2 of the second switching transistor SW2. That is, the voltage VE is larger than the voltage obtained by adding the precharge voltage VPCG and the threshold voltage Vthsw2. Consequently, the second switching transistor SW2 is in the on state in the first period T1.

The multiplexer signal MUXR is transmitted from the control circuit 130 (FIG. 2) to the gate electrode 352 of the first switching transistor SW1 via the input terminal in3 of the bootstrap circuit 114A. The multiplexer signal MUXR is supplied with a voltage VF which is an analog voltage from the voltage VA. The voltage VF is, for example, 8 V.

The voltage VF is a voltage larger than the voltage VE transmitted to the first electrode 350 of the first switching transistor SW1 by at least a threshold voltage Vthsw1 of the first switching transistor SW1. That is, the voltage VF is a voltage equal to or higher than the voltage obtained by adding the voltage VE and the threshold voltage Vthsw1. Consequently, the first switching transistor SW1 is in the on state in the first period T1.

In an embodiment, for example, the on state refers to a state in which the source electrode and the drain electrode of the transistor are conductive and the current flows through the transistor, and a state in which the transistor is conductive (conductive state) and the switch is in the on state (ON). In an embodiment, for example, the off state refers to a state in which the source electrode and the drain electrode of the transistor are non-conductive and no current flows through the transistor, and a state in which the transistor is non-conductive (non-conductive state) and the switch is in the off state (OFF).

In an embodiment, the first electrode of the transistor is one electrode of the source electrode and the drain electrode, and the second electrode of the transistor is the other electrode of the source electrode and the drain electrode. In each transistor, the source electrode and the drain electrode may be replaced depending on the voltage of each electrode. It will be readily understood by those skilled in the art that a slight current flows, such as a leakage current, even when the transistor or switch is not carrying a current, or is in the off state.

<1-2-2. Second Period T2>

A driving method of the display device 10 in a second period T2 will be described with reference to FIG. 4 and FIG. 6. The second period T2 is a period in which the node A is in a floating state, the bootstrap capacitance Cbst is used to boost the voltage of the node A, the second switching transistor SW2 is in the on state, and supplies an image signal VR (second analog voltage) from the first electrode 360 of the second switching transistor SW2 to the second electrode 364, the node B, the output electrode out, the image signal line 321 electrically connected to the output terminal out, and the sub-pixel R electrically connected to the image signal line 321.

As shown in FIG. 4 or FIG. 6, the gate control signal VGATE is supplied with the voltage VE from the IC chip 160 (FIG. 2). The first electrode 350 of the first switching transistor SW1 continues to be supplied with the voltage VE. The multiplexer signal MUXR is supplied with a voltage VC which is an analog voltage from the voltage VF which is an analog voltage. The voltage VC is, for example, 1 V.

Relative to the first switching transistor SW1, the difference between the voltage VC supplied to the gate electrode 352 and the voltage VE supplied to the first electrode 350 is smaller than the voltage for turning on the first switching transistor SW1, and the first switching transistor SW1 is in the off state in the second period T2. Consequently, the node A, the gate electrode 362 of the second switching transistor SW2, and the first electrode 430 of the bootstrap capacitance Cbst are in the floating state.

The image data signal VDATA here is supplied with a signal including the image signal VR, which is an analog voltage, from the precharge voltage VPCG, which is an analog voltage. The image signal VR is, for example, an analog signal between 0 V and 4 V. In this case, black is displayed at 0 V, white is displayed at 4 V, and a halftone is expressed depending on a potential larger than 0 V and smaller than 4 V. The image signal VR, which is an analog voltage, is greater than the precharge voltage VPCG. As the image data signal VDATA changes from the precharge voltage VPCG to the image signal VR, which is an analog voltage, the voltages of the node A and the gate electrode 362 of the second switching transistor SW2 are boosted using the bootstrap capacitance Cbst. For example, the voltage of the node A and the voltage of the gate electrode 362 of the second switching transistor SW2 are boosted from the voltage VE to the voltage VE+dV (third analog voltage).

In the first period T1, the voltage of the node A and the voltage of the gate electrode 362 of the second switching transistor SW2 are a voltage for turning on the second switching transistor SW2 relative to the precharge voltage VPCG. That is, in the second period T2, the voltage of the boosted node A and the voltage of the gate electrode 362 of the second switching transistor SW2 are boosted to a voltage that turns on the second switching transistor SW2 relative to the image signal VR, which is an analog voltage.

Therefore, in the second period T2, since the second switching transistor SW2 is in a state of being sufficiently turned on, the image signal VR is supplied from the first electrode 360 of the second switching transistor SW2 to the second electrode 364, the node B, the output electrode out, the image signal line 321 electrically connected to the output terminal out, and the sub-pixel R electrically connected to the image signal line 321.

<1-2-3. Third Period T3>

The driving of the display device 10 in the third period T3 will be described with reference to FIG. 4 and FIG. 7. The third period T3 is a period for holding the voltages of the second electrode 364, the node B, the image signal line 321 electrically connected to the output terminal out, and the sub-pixel R electrically connected to the image signal line 321 in the image signal VR.

As shown in FIG. 4 or FIG. 7, the gate control signal VGATE is supplied with the voltage VA (fourth analog voltage) from the IC chip 160 (FIG. 2). That is, the first electrode 350 of the first switching transistor SW1 is supplied with the voltage VA from the voltage VE. The multiplexer signal MUXR continues to be supplied with the voltage VC, which is an analog voltage.

Relative to the first switching transistor SW1, the difference between the voltage VC supplied to the gate electrode 352 and the voltage VA supplied to the first electrode 350 is a voltage for turning on the first switching transistor SW1, and the first switching transistor SW1 is in the on state in the third period T3. Consequently, the voltages of the node A, the gate electrode 362 of the second switching transistor SW2 and the first electrode 430 of the bootstrap capacitance Cbst change from the voltage VE+Vd to the voltage VA.

The image data signal VDATA continues to be supplied with a signal including the image signal VR, which is an analog voltage.

Relative to the second switching transistor SW2, the difference between the voltage VA supplied to the gate electrode 362 and the image signal VR which is an analog voltage supplied to the first electrode 360 is smaller than the voltage for turning on the second switching transistor SW2, and the second switching transistor SW2 is in the off state in the third period T3.

Consequently, in the third period T3, the image signal VR supplied to the second electrode 364, the node B, the output electrode out, the image signal line 321 electrically connected to the output terminal out, and the sub-pixel R electrically connected to the image signal line 321 in the second period T2 is held.

In the second time-division period TD2 and the third time-division period TD3 following the first time-division period TD1, the multiplexer signal MUXR is supplied with VA, which is an analog voltage, from the voltage VC, which is an analog voltage. Therefore, in the second time-division period TD2 and the third time-division period TD3, the first switching transistor SW1 is in the off state.

In the conventional display device, similar to an embodiment, in the case where the 1H is divided into three and the time-division driving method is used to allocate each ⅓ period of the 1H to periods for transmitting the image signal to each of the sub-pixel R, sub-pixel G, and the sub-pixel B, the time required for transmitting a voltage comparable to the voltage of the image signal to the source signal line is ⅓ of the 1H. In this case, in order for the analog switch to perform the equivalent drive to the 1H, for example, during ⅓ period of the 1H, the gate electrode of the analog switch (switching transistor) is supplied with a high voltage (e.g., 8 V) as high as the voltage VF. In the conventional display device, the voltage supplied to the gate electrode of the analog switch is set to a high voltage, and the analog switch is controlled to transmit a voltage as high as the voltage of the image signal to the source signal line. Alternatively, in the conventional display device, in the case where it is difficult to set the voltage supplied to the gate electrode of the analog switch to a high voltage, the channel width of the transistor of the analog switch was increased so that a current equal to the amount of current output when a high voltage is supplied to the gate electrode of the analog switch can flow. In the conventional display device, in any of the cases described above, the gate electrode of the analog switch is subjected to a large load, and the electrical characteristic of the analog switch easily deteriorates.

On the other hand, in the display device 10, the switching transistor SW1 can make the second period of ⅓ period of the 1H in the off state by using the bootstrap circuit 114. Therefore, the period in which the switching transistor SW1 is in the on state can be shorter than the analog switch in the conventional display device. Therefore, in the display device 10, it is possible to reduce the load (on-stress) on the switching transistor SW1. Consequently, by using the display device 10, it is possible to suppress the degradation of the electrical characteristic of the switching transistor SW1.

In the display device 10, the voltage of the gate electrode of the switching transistor SW2 can be boosted using the bootstrap capacitance Cbst. Therefore, it is sufficient that the voltage of the gate electrode of the switching transistor SW2 is a voltage of about the threshold Vthsw2 of the switching transistor SW2 in the first period before boosting using the bootstrap capacitance Cbst. Therefore, the switching transistor SW1 that transmits an analog voltage to the gate electrode of the switching transistor SW2 may transmit a voltage of about the threshold Vthsw2 of the switching transistor SW2 to the gate electrode of the switching transistor SW2. Therefore, the drive voltage of the switching transistor SW1 can be made smaller than the drive voltage of the analog switch in the conventional display device. Consequently, in the display device 10, it is possible to reduce the load on the switching transistor SW1, and it is possible to suppress the degradation of the electrical characteristic of the switching transistor SW1.

Furthermore, in the display device 10, the switching transistor SW2 can make the third period of ⅓ period of the 1H in the off state. Therefore, the period in which the switching transistor SW2 is in the on state can be shorter than the analog switch in the conventional display device. Therefore, in the display device 10, it is possible to reduce the load (on-stress) on the switching transistor SW2. Consequently, it is possible to suppress the degradation of the electrical characteristic of the switching transistor SW2 by using the display device 10.

In the display device 10, the voltage of the gate electrode of the switching transistor SW2 is a voltage of about the analog voltage+the threshold Vthsw2 of the image data signal VDATA depending on the analog voltage of the image data signal VDATA. The voltage of the gate electrode of the switching transistor SW2 is smaller than the drive voltage of the analog switch in the conventional display device. Therefore, in the display device 10, it is possible to reduce the load (on-stress) on the switching transistor SW2. Consequently, it is possible to suppress the degradation of the electrical characteristic of the switching transistor SW2 by using the display device 10.

The display device 10 including the bootstrap circuit 114 can transmit a voltage comparable to the voltage of the image signal to the source signal line by the switching transistor SW2 without increasing the channel widths of the switching transistor SW1 and the switching transistor SW2. Therefore, the display device 10 can be reduce the size of the source driver circuit 110 as compared with the conventional display device in which the channel width of the analog switch is increased. As a result, the display device 10 can reduce the so-called width of the picture frame, so that the display area 22 can be increased.

2. Second Embodiment

In the second embodiment, an example in which the bootstrap circuit 114B is applied to a pixel 170B of an EL display device 10B will be described with reference to FIG. 8 to FIG. 13. The configuration is the same as the configuration described in the first embodiment, except that the bootstrap circuit 114B is applied to the pixel 170B of the EL display device 10B. The display device 10B shown in FIG. 8 to FIG. 13 is merely an example, and the display device 10B is not limited to the example shown in FIG. 8 to FIG. 13. The same or similar configurations as those in FIG. 1 to FIG. 7 will be described as necessary.

<2-1. Summary of Display Device 10B>

Figure 8:
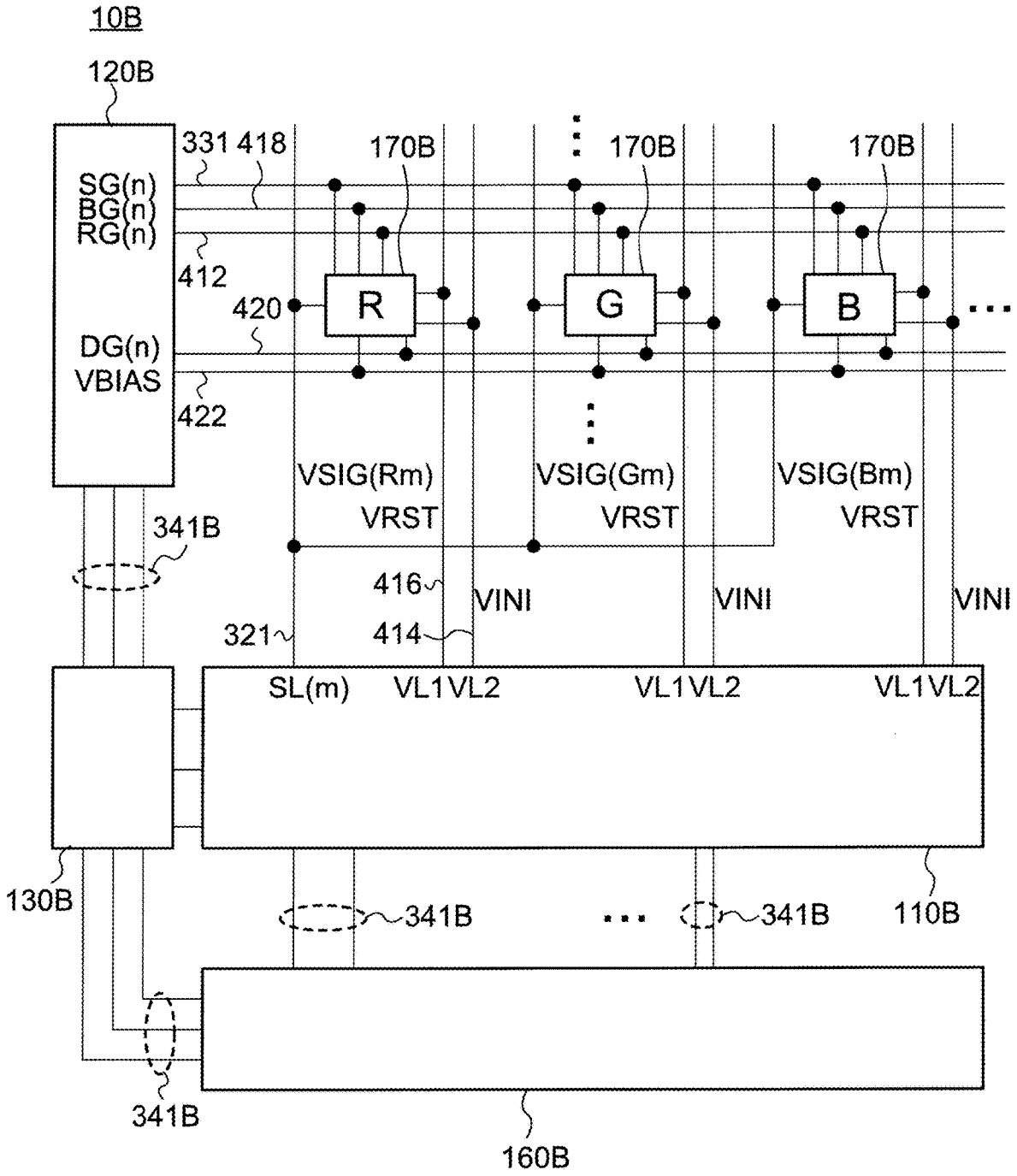
FIG. 8 is a schematic diagram showing a configuration of a display device according to an embodiment.

An outline of the display device 10B will be described with reference to FIG. 8. FIG. 8 is a schematic plan view showing the configuration of the display device 10B. The configuration of display device 10B shown in FIG. 8 is merely an example, and the configuration of display device 10B is not limited to the configuration shown in FIG. 8. The same or similar configurations as those in FIG. 1 to FIG. 7 will be described as necessary.

As shown in FIG. 8, the display device 10B has a configuration in which each of the source driver circuit 110, the gate driver circuit 120, the control circuit 130, and the IC chip 160 shown in FIG. 1 and FIG. 2 is replaced with a source driver circuit 110B, a gate driver circuit 120B, a control circuit 130B, and an IC chip 160B. As shown in FIG. 8, in the display device 10B, the pixel arranged in the display area 22 is the pixel 170B having an EL display element. The pixel 170B shown in FIG. 8 has the same configuration and arrangement as the configuration and arrangement of the pixel 170 shown in FIG. 1 and FIG. 2.

The imaging signal line 321 extends from the source driver circuit 110B in the first direction D1 and is connected to a plurality of pixels 170B arranged in the first direction D1. The scanning signal line 331 extends from the gate driver circuit 120B in the second direction D2 and is connected to the plurality of pixels 170B arranged in the second direction D2. The control circuit 130B is connected to the source driver circuit 110B and the gate driver circuit 120B using a connection wiring 341B. In an embodiment, the connection wiring 341B may be referred to as the connection wiring 341B independently, and a bundle of a plurality of connection wirings 341B may be referred to as the connection wiring 341B.

The source driver circuit 110B includes a plurality of 3-selection multiplexer circuits (not shown). The 3-selection multiplexer circuit has three switching transistors. Each of the three switching transistors transfers the image data signal corresponding to different colors to different signal lines from each other. The source driver circuit 110B may include the 3-selection multiplexer circuit 112 similar to that of the first embodiment.

The IC chip 160B is electrically connected to the source driver circuit 110B and the control circuit 130B using the connection wiring 341B. The IC chip 160B uses the connection wiring 341B to transmit the control signal and voltage of the source driver circuit 110B to the source driver circuit 110B, and transmit the control signal and voltage of the gate driver circuit 120B, and the control signal and voltage of the source driver circuit 110B to the control circuit 130B. For example, the IC chip 160B transmits the image data signal SL (m) to the source driver circuit 110B. The control signal and voltage of the source driver circuit 110B include the image data signal SL (m).

The control circuit 130B is electrically connected to the source driver circuit 110B and the gate driver circuit 120B using the connection wiring 341B. The control circuit 130B uses the connection wiring 341B to transmit the control signal and voltage of the gate driver circuit 120B received from the IC chip 160B to the gate driver circuit 120B, and transmit the control signal and voltage of the source driver circuit 110B received from the IC chip 160B to the source driver circuit 110B. For example, the control circuit 130B transmits the control signal and voltage of the gate driver circuit 120B to the gate driver circuit 120B. The control circuit 130B has the same configuration and function as the control circuit 130.

The control circuit 130B may, for example, use the control signal and voltage received from the IC chip 160 to generate a scanning signal SG (n), a light emission control signal BG (n), a reset signal RG (n), a first initialization signal VL1, a second initialization signal VL2, a data control signal DG (n), a bias control signal, a bias voltage VBIAS, a reset voltage VRST, and an initialization voltage VINI, and transmit the generated respective signals and voltages to the gate driver circuit 120B or the source driver circuit 110B. In an embodiment, the bias voltage VBIAS, the reset voltage VRST, and the initialization voltage VINI are analog voltages.

The gate driver circuit 120B receives the scanning signal SG (n), the light emission control signal BG (n), the reset signal RG (n), the data control signal DG (n), and the bias control signal from the control circuit 130B and transmits the scanning signal SG (n), the light emission control signal BG (n), the reset signal RG (n), the data control signal DG (n), and the bias control signal to the pixel 170B.

The scanning signal SG (n) is supplied to the scanning signal line 331 and transmitted to the pixel 170B. The light emission control signal BG (n) is supplied to a light emission control signal line 418 and transmitted to the pixel 170B. The reset signal RG (n) is supplied to a reset signal line 412 and transmitted to the pixel 170B. The data control signal DG (n) is supplied to a data control signal line 420 and transmitted to the pixel 170B. The bias control signal is supplied to a bias control signal line 422 and transmitted to the pixel 170B. The bias control signal includes the bias voltage VBIAS.

The source driver circuit 110B receives the first initialization signal VL1 and the second initialization signal VL2 from the control circuit 130B. The source driver circuit 110B transmits the first initialization signal VL1 and the second initialization signal VL2 to the pixel 170B. The source driver circuit 110B receives the image data signal SL (m) from the IC chip 160B. The source driver circuit 110B transmits the image data signal SL (m) to the pixel 170B. In an embodiment, the image data signal SL (m) includes, for example, an image signal VSIG (Rm), an image signal VSIG (Gm), and an image signal VSIG (Bm), the first initialization signal VL1 includes the reset voltage VRST, and the second initialization signal VL2 includes the initialization voltage VINI. In an embodiment, the image signal VSIG (Rm), the image signal VSIG (Gm), and the image signal VSIG (Bm) are analog voltages.

The first initialization signal VL1 is supplied to a first initialization signal line 416 and transmitted to the pixel 170B. The second initialization signal VL2 is provided to a second initialization signal line 414 and transmitted to the pixel 170B. The image data signal SL (m) is supplied to the image signal line 321 and transmitted to the pixel 170B.

<2-2. Pixels>

Figure 9:
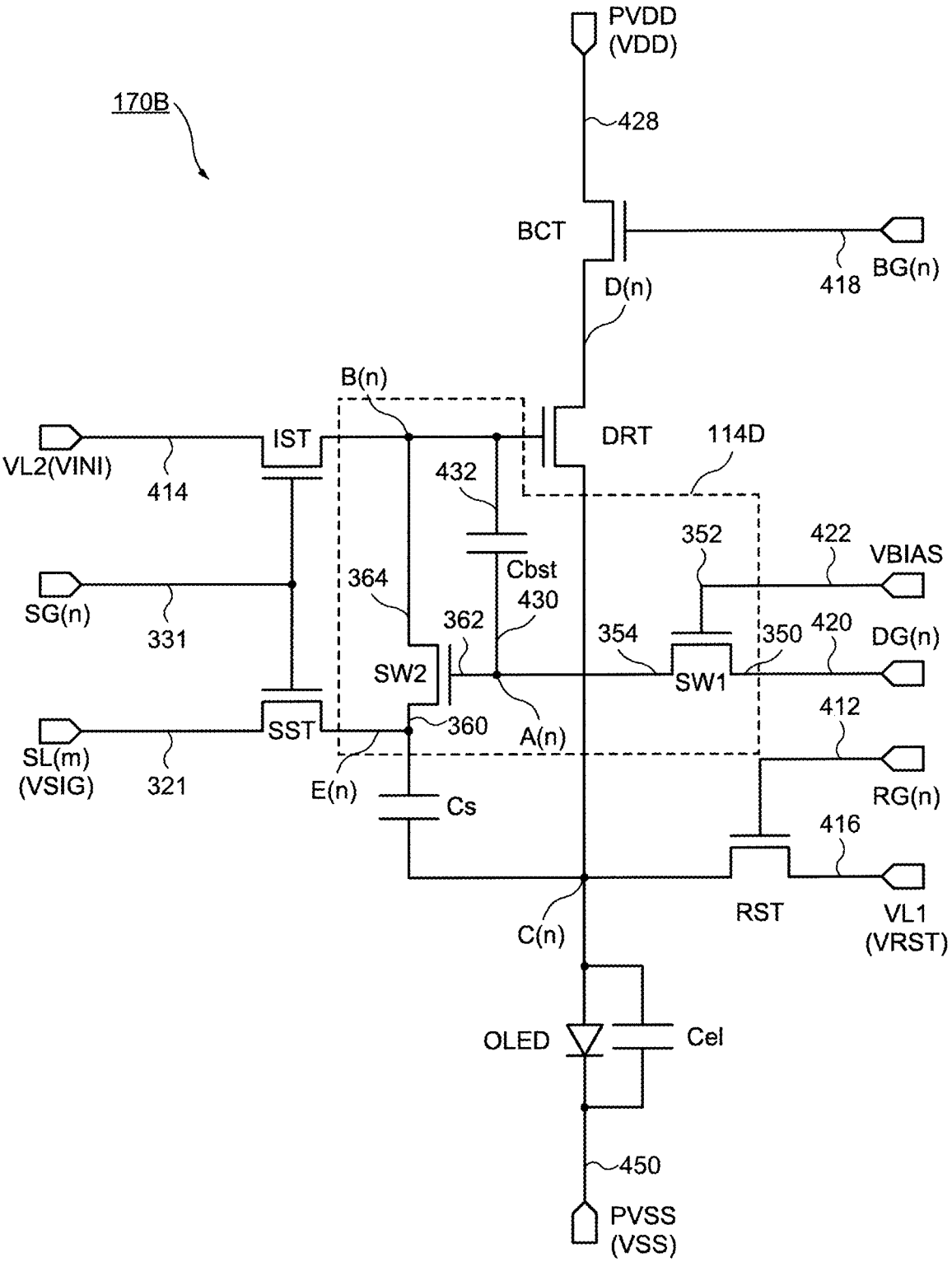
FIG. 9 is a circuit diagram showing a circuit configuration of a pixel according to an embodiment.

The configuration of the pixel 170B will be described with reference to FIG. 9. FIG. 9 is a circuit diagram showing a circuit configuration of the pixel 170B. The configuration of the pixel 170B shown in FIG. 9 is merely an example and the configuration of the pixel 170B is not limited to the configuration shown in FIG. 9. The same or similar configurations as those in FIG. 1 to FIG. 8 will be described as necessary. In an embodiment, the pixel 170B is also referred to as a sub-pixel.

As shown in FIG. 9, the pixel 170B includes a drive transistor DRT, a select transistor SST, an initialization transistor IST, a reset transistor RST, a light emission control transistor BCT, the switching transistor SW1, the switching transistor SW2, the bootstrap capacitance Cbst, a storage capacitor Cs, a light-emitting element OLED, and an additional capacitor Cel. Each of these transistors has a gate electrode, a pair of terminals (source electrode, drain electrode) consisting of a first electrode and a second electrode. Each of the bootstrap capacitance Cbst, the storage capacitor Cs, and the additional capacitor Cel has a pair of terminals (first terminal, second terminal). The pair of terminals described above is also referred to as a pair of electrodes. Although an example of providing the additional capacitor Cel in parallel with the light-emitting element OLED is shown in FIG. 9, the present invention is not limited to this. The additional capacitor Cel may be a parasitic capacitance of the light-emitting element OLED, or may include the capacity element and a parasitic capacitance of the light-emitting element OLED provided in parallel with the light-emitting element OLED. A high potential VDD is supplied from a drive power supply line PVDD and a reference potential VSS is supplied from a reference potential line PVSS as a power source for driving the light-emitting element OLED. The reset voltage VRST is smaller than the high potential VDD supplied from the drive power supply line PVDD and can be substantially the same as the reference potential VSS.

As shown in FIG. 9, the pixel 170B includes a bootstrap circuit 114D. A configuration and a function of the bootstrap circuit 114D are the same as those of the bootstrap circuit 114 shown in FIG. 3. The first electrode 350 of the switching transistor SW1 is electrically connected to the data control signal line 420 and is supplied with the data control signal DG (n). The gate electrode 352 of the switching transistor SW1 is electrically connected to the bias control signal line 422 and is supplied with a signal that includes the bias voltage VBIAS. The drain electrode of the initialization transistor IST, the gate electrode of the drive transistor DRT, the second electrode 364 of the switching transistor SW2, and the second electrode 432 of the bootstrap capacitance Cbst are electrically connected to the node B (n). The drain electrode of the select transistor SST, the first electrode 360 of the switching transistor SW2, and the first terminal of capacity element Cs are electrically connected to a node E (n). The drain electrode of the reset transistor RST, the source electrode of the drive transistor DRT, the second terminal of storage capacitor device Cs, the first terminal of the light-emitting element OLED, and the first terminal of the additional capacitor Cel are electrically connected to a node C (n). The drain electrode of the drive transistor DRT and the source electrode of the light emission control transistor BCT are electrically connected to a node D (n).

The node E (n), a part of the bias control signal line 422, a part of the data control signal line 420, the node B (n), and the node A (n) shown in FIG. 9 correspond to the input terminal in1, the input terminal in2, the input terminal in3, the node B, and the node A shown in FIG. 3, respectively. Since the output terminal out shown in FIG. 3 is electrically connected to the node B, the node B (n) shown in FIG. 9 also corresponds to the output terminal.

The configuration and the function of the switching transistor SW1 and the switching transistor SW2 shown in FIG. 9 has the same configuration and function as the switching transistor SW1 and the switching transistor SW2 shown in FIG. 3. Each transistor other than the switching transistor SW1 and the switching transistor SW2 may have the same configuration and function as the switching transistor SW1 and the switching transistor SW2. For example, the channel area of each transistor shown in FIG. 9 may contain an oxide semiconductor, the channel area of the switching transistor SW1 and the switching transistor SW2 may contain an oxide semiconductor, and the channel area of each transistor other than the switching transistor SW1 and the switching transistor SW2 may contain low-temperature polysilicon. The transistor containing the low-temperature polysilicon may be an n-channel type field effect transistor or a p-channel type field effect transistor. The display device 10B may appropriately adapt the configuration of the transistor, layout, connection of a storage capacitor, and a power supply voltage, and the like depending on the application and specifications.

The drive transistor DRT has the roles of passing a current through the light-emitting element OLED and emitting the light-emitting element OLED based on an input video signal. The select transistor SST has the role of supplying the video signal to the drive transistors DRT. The initialization transistor IST has the role of supplying the initialization voltage VINI to the node B (n) and the gate electrode or the like of the drive transistor DRT and resetting the drive transistor DRT. The light emission control transistor BCT controls the connection and disconnection of the drive power supply line PVDD and the drive transistor DRT. In other words, the light emission control transistor BCT may control the electrical connection and disconnection between the drive transistor DRT and the light-emitting element OLED, and between the drive transistor DRT and the additional capacitor Cel. That is, the light emission control transistor BCT has the role of controlling the emission or non-emission of the light-emitting element OLED. The reset transistor RST has the role of supplying the reset voltage VRST to the second terminal of the storage capacitor Cs and the first terminal of the light-emitting element OLED, and resetting the source of the drive transistor DRT and the light-emitting element OLED. The first terminal of the light-emitting element OLED is a pixel electrode. The storage capacitor Cs has the role of ensuring a voltage corresponding to the threshold of the drive transistor DRT. The storage capacitor Cs has the role of maintaining the voltage input to the gate of the drive transistor DRT for the pixel 170B to emit light. That is, the storage capacitor Cs has the role of holding a gradation level of the input image signal. The light-emitting element OLED has diode characteristics. The light-emitting element OLED includes a pixel electrode, a common electrode 450, and a light-emitting layer (functional layer, organic layer) located between the pixel electrode and the common electrode 450. The additional capacitor Cel is the capacitance contained in the light-emitting element OLED. In an embodiment, the additional capacitor Cel and capacity element Cs may hold the image signal. In an embodiment, the gradation level is an analog voltage, and the image signal VSIG (Rm), the image signal VSIG (Gm), and the image signal VSIG (Bm) respectively include each gradation level.

The gate electrode of the initialization transistor IST is electrically connected to the scanning signal line 331. The scanning signal SG (n) is supplied to the scanning signal line 331. In the initialization transistor IST, the conduction state and the non-conductive state are controlled by the signal supplied to the scanning signal SG (n). When the signal supplied to the scanning signal SG (n) is a low voltage, the initialization transistor IST is in the non-conductive state. When the signal supplied to the scanning signal SG (n) is a high voltage, the initialization transistor IST is in a conductive state. The source-electrode of the initialization transistor IST is electrically connected to the second initialization signal line 414. The second initialization signal line 414 is supplied with the second initialization signal VL2. The drain electrode of the initialization transistor IST is electrically connected to the gate electrode of the drive transistor DRT, the second electrode 364 of the switching transistor SW2, and the first terminal of the storage capacitor Cs. The second terminal of the storage capacitor Cs is electrically connected to the source electrode of the drive transistor DRT, the drain electrode of the reset transistor RST, the first terminal of the light-emitting element OLED, and the first terminal of the additional capacitor Cel.

The gate electrode of the select transistor SST is electrically connected to the scanning signal line 331. The scan signal SG (n) is supplied to the scanning signal line 331. The select transistor SST is controlled in a conductive state and a non-conductive state by a signal supplied to the scanning signal SG (n). When the signal supplied to the scanning signal SG (n) is a low voltage, the select transistor SST is in a non-conductive state. When the signal supplied to the scanning signal SG (n) is a high voltage, the select transistor SST is in a conductive state. The source-electrode of the select transistor SST is electrically connected to the image signal line 321. The image signal line 321 is supplied with the image data signal SL (m). The drain electrode of the select transistor SST is electrically connected to the first electrode 360 of the switching transistor SW2 and to the first terminal of the storage capacitor Cs.

The gate electrode of the light emission control transistor BCT is electrically connected to the light emission control signal line 418. The light emission control signal BG (n) is supplied to the light emission control signal line 418. The light emission control transistor BCT is controlled in a conduction state or non-conduction state by a signal supplied to the light emission control signal BG (n). When the signal supplied to the light emission control signal BG (n) is a low voltage, the light emission control transistor BCT is in a non-conductive state. When the signal supplied to the light emission control signal BG (n) is a high voltage, the light emission control transistor BCT is in a conductive state. The drain electrode of the light emission control transistor BCT is electrically connected to the drive power supply line PVDD. The drive power supply line PVDD is a drive power supply line 428. The source electrode of the light emission control transistor BCT is electrically connected to the drain electrode of the drive transistor DRT. The source electrode of the reset transistor RST is electrically connected to the first initialization signal line 416. The first initialization signal line 416 is supplied with the reset voltage VRST.

The second terminal of the light-emitting element OLED and the second terminal of the additional capacitor Cel are electrically connected to the reference voltage line PVSS.

<2-3. Driving Method of Display Device 10B>

The driving method of the display device 10B will be described with reference to FIG. 10 to FIG. 13. The driving method of the display device 10B shown in FIG. 10 to FIG. 13 is merely an example and the driving method of the display device 10B is not limited to the configuration shown in FIG. 10 to FIG. 13. The same or similar configurations as those in FIG. 1 to FIG. 9 will be described as necessary.

Figure 10:
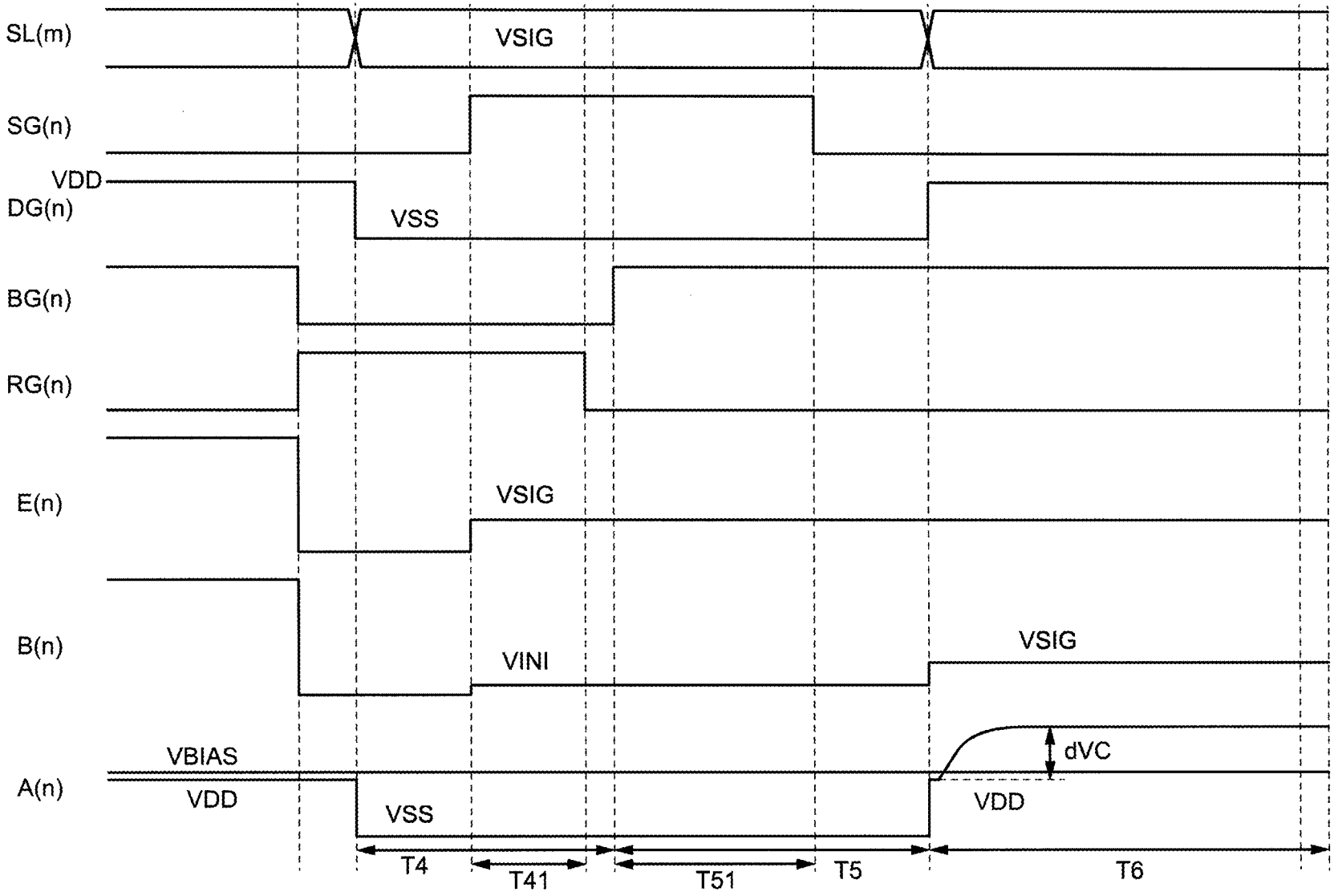
FIG. 10 is a schematic diagram showing a timing chart of a display device according to an embodiment.
Figure 11:
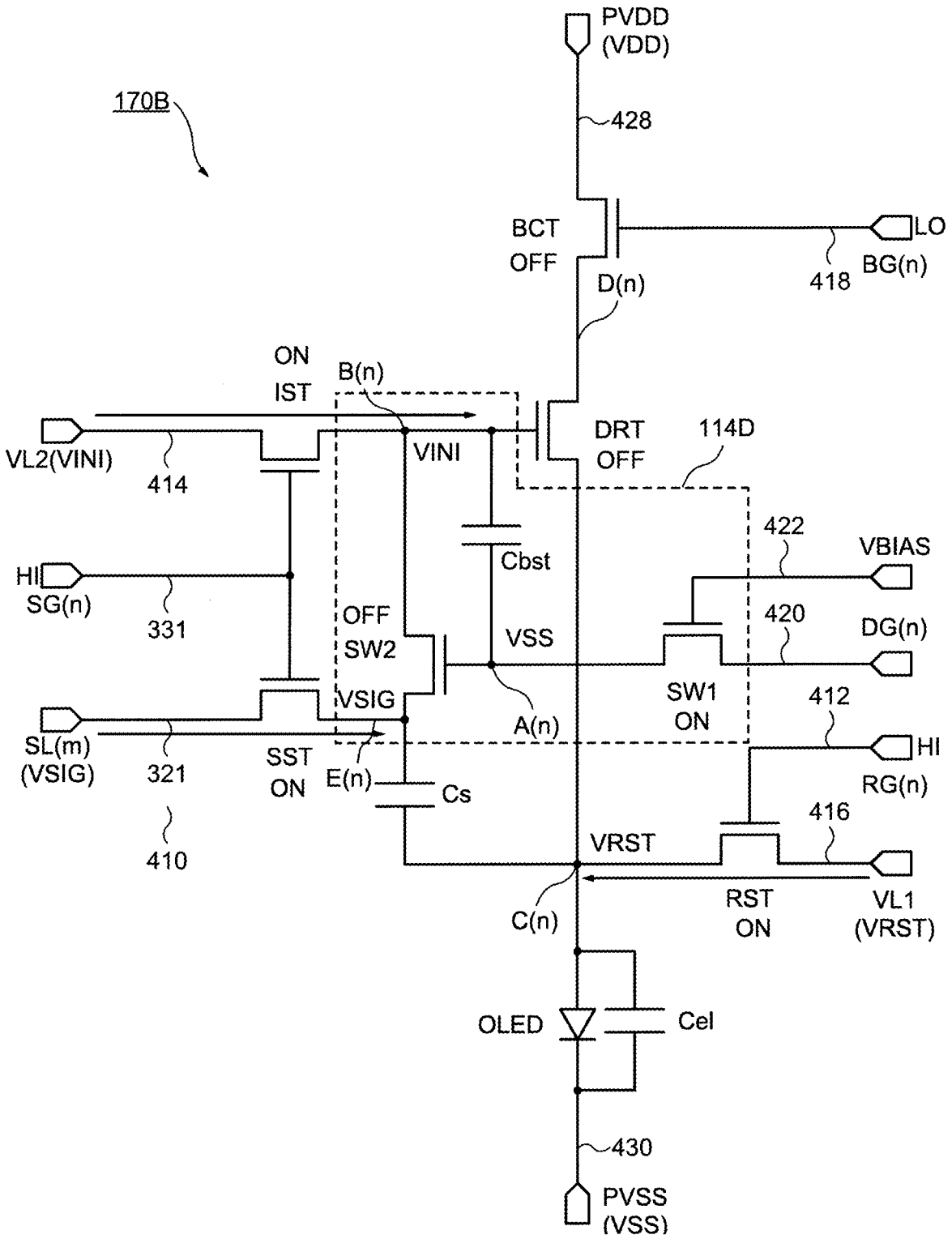
FIG. 11 is a schematic diagram showing an operating state of a pixel at the timing shown in FIG. 10.
Figure 12:
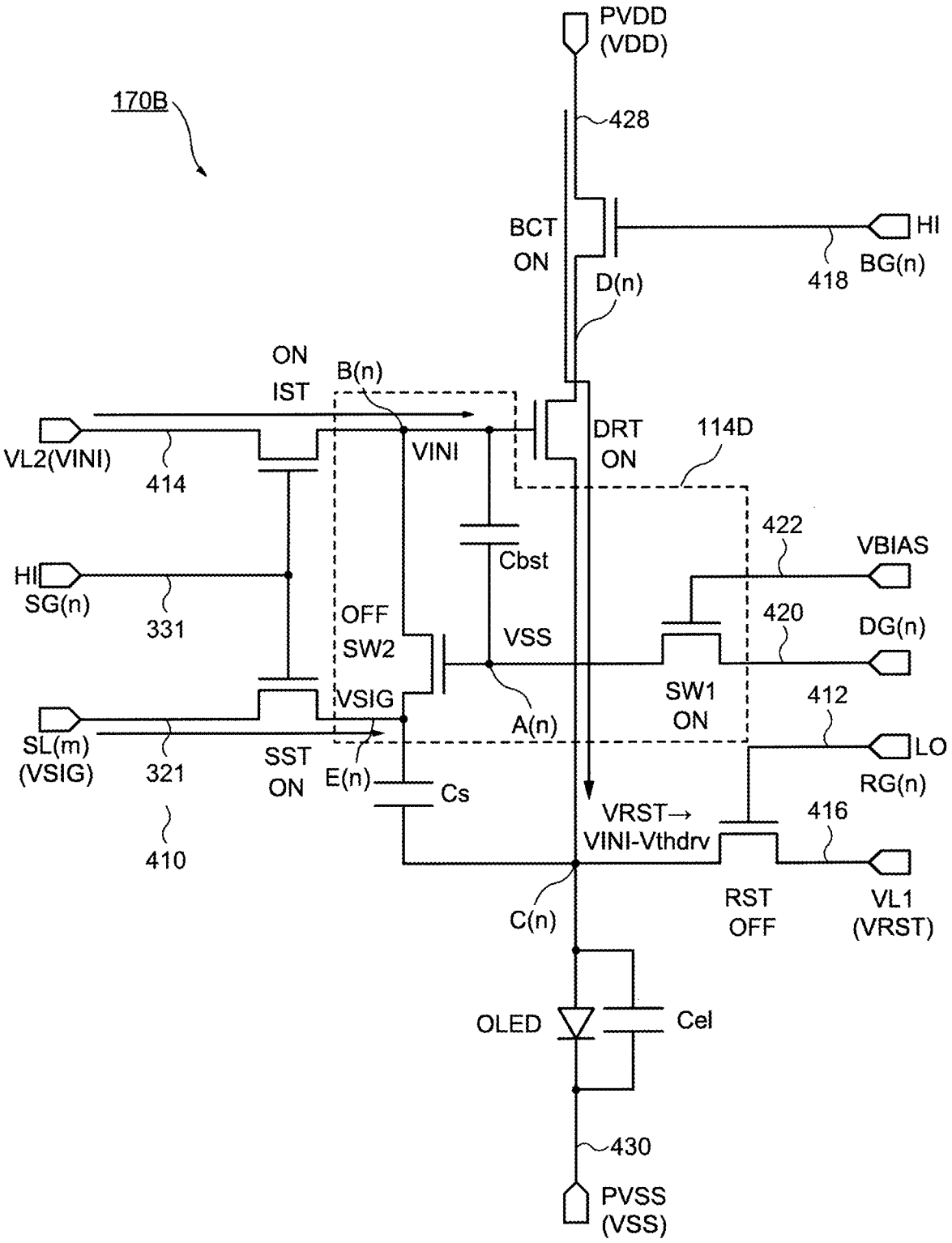
FIG. 12 is a schematic diagram showing an operating state of a pixel at the timing shown in FIG. 10.
Figure 13:
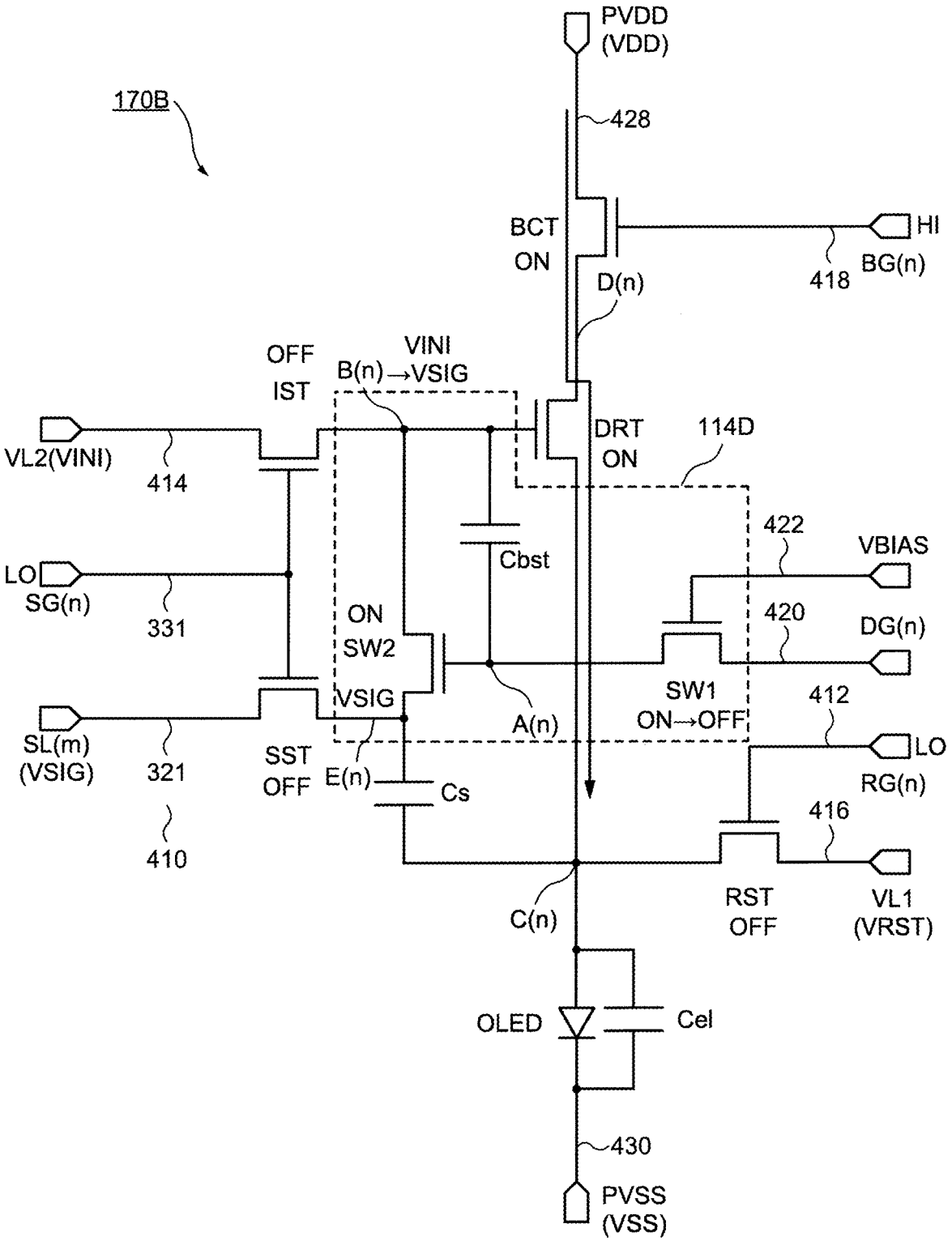
FIG. 13 is a schematic diagram showing an operating state of a pixel at the timing shown in FIG. 10.

FIG. 10 is a schematic diagram showing a timing chart of the display device 10B, FIG. 11 is a schematic diagram showing an operation state of the pixel 170B at the timing shown in FIG. 10 (fourth period T4), FIG. 12 is a schematic diagram showing an operation state of the pixel 170B at the timing shown in FIG. 10 (fifth period T5), and FIG. 13 is a schematic diagram showing an operation state of the pixel 170B at the timing shown in FIG. 10 (sixth period T6). In an embodiment, the state of the pixel 170B in the n-th row and m-th column will be described as an example.

<2-3-1. Fourth Period T4>

In an embodiment, the fourth period is referred to as a reset period. In the reset period, the drive transistor DRT becomes non-conductive when the initialization voltage VINI is supplied to the node B (n), and the pixel 170B is reset when the reset voltage VRST is supplied to the node C (n). The first driving method of the fourth period T4 will be described with reference to FIG. 9 and FIG. 10. As shown in FIG. 10, in the fourth period T4, first, a low voltage is supplied to the scanning signal SG (n), the data control signal DG (n), and the light emission control signal BG (n). The low voltage is, for example, a voltage VSS. The bias voltage VBIAS is supplied to the bias control signal line 422, and a high voltage is supplied to the reset signal RG (n). When a description is made with reference to the circuit diagram of FIG. 9, the select transistor SST and the light emission control transistor BCT are in a non-conductive state, and the switching transistor SW1 and the reset transistor RST are in a conductive state. Although the drive transistor DRT is assumed to be in a non-conductive state, it may be in a conductive state. In this case, the reset voltage VRST is supplied to the drain electrode of the reset transistor RST, the source electrode of the drive transistor DRT, the second terminal of the storage capacitor Cs, the first terminal of the light-emitting element OLED (pixel electrode), and the first terminal of the additional capacitor Cel. A low voltage (VSS) is supplied from the first electrode 350 of the switching transistor SW1 via the second electrode 354 to the node A (n), the gate electrode 362 of the switching transistor SW2, and the first electrode 430 of the bootstrap capacitance Cbst. The voltage at the node A (n) is a low voltage and the switching transistor SW2 is in a non-conductive state. The voltage at the node C (n) is the reset voltage VRST.

A 41st period T41 included in the fourth period T4 will be described with reference to FIG. 10 and FIG. 11. In the 41st period T41, the voltage supplied to the scan signal SG (n) changes to a high voltage from a low voltage. The voltage supplied to the image data signal SL (m) is the image signal VSIG which is an analog voltage. The data control signal DG (n) and the light emission control signal BG (n) continue to be supplied with a low voltage. The bias control signal line 422 continues to be supplied with the bias voltage VBIAS, and the reset signal RG (n) continues to be supplied with a high voltage. Therefore, the initialization transistor IST, the select transistor SST, the switching transistor SW1, and the reset transistor RST are in a conductive state, and the switching transistor SW2 and the light emission control transistor BCT are in a non-conductive state.

As a result, in the 41st period T41, the initialization voltage VINI supplied to the second initialization signal line 414 is supplied to the node B (n), the drain electrode of the initialization transistor IST, the gate electrode of the drive transistor DRT, the second electrode 364 of the switching transistor SW2, and the second electrode 432 of the bootstrap capacitance Cbst. The image signal VSIG, which is an analog voltage, is supplied to the node E (n), the drain electrode of the select transistor SST, the first electrode 360 of the switching transistor SW2, and the first terminal of the storage capacitor Cs. Since the gate electrode of the drive transistor DRT is supplied with the initialization voltage VINI, the drive transistor DRT is in a non-conductive state.

Consequently, the voltage of the node A (n) is the low voltage (VSS), the voltage of the node B (n) is the initialization voltage VINI, the voltage of the node C (n) is the reset voltage VRST, and the voltage of the node E (n) is the image signal VSIG which is an analog voltage.

<2-3-2. Fifth Period T5>

In an embodiment, the fifth period is referred to as a sampling period. A driving method of a 51st period T51 included in the fifth period T5 will be described with reference to FIG. 10 and FIG. 12.

The scanning signal SG (n) continues to be supplied with a high voltage, the bias control signal line 422 continues to be supplied with the bias voltage VBIAS, the data control signal DG (n) continues to be supplied with a low voltage, the light emission control signal BG (n) is supplied with a high voltage from a low voltage, and the reset signal RG (n) is supplied with a low voltage from a high voltage.

Therefore, the initialization transistor IST, the select transistor SST, the switching transistor SW1, the light emission control transistor BCT, and the drive transistor DRT are in a conductive state, and the switching transistor SW2 and the reset transistor RST are in a non-conductive state.

Therefore, in the 51st time period T51, the initialization voltage VINI supplied to the second initialization signal line 414 continues to be supplied to the node B (n), the drain electrode of the initialization transistor IST, the gate electrode of the drive transistor DRT, the second electrode 364 of the switching transistor SW2, and the second electrode 432 of the bootstrap capacitor Cbst, and the image signal VSIG, which is an analog voltage, continues to be supplied to the node E (n), the drain electrode of the select transistor SST, the first electrode 360 of the switching transistor SW2, the first terminal of the storage capacitor Cs, and the scanning signal SG (n), and the node A (n) continues to be supplied with the low voltage (VSS).

The light emission control transistor BCT is connected to the drive power supply line 428 and a voltage VDD is supplied to the node D (n) from the drive power supply line PVDD. That is, the voltage of the node D (n) becomes the voltage VDD. Since the voltage of the node B (n) is the initialization voltage VINI, the voltage of the node D (n) is the voltage VDD and the voltage of the node C (n) is the reset voltage VRST, the drive transistor DRT is in a conductive state. As a result, the source electrode of the drive transistor DRT and the second terminal of the storage capacity element Cs are charged. Consequently, the voltage at the node C (n) is increased from the reset voltage VRST. The voltage of the node B (n) is the initialization voltage VINI. As a result, the drive transistor DRT becomes a non-conductive state, when the voltage of the source electrode of the drive transistor DRT is lower than the initialization voltage VINI by the threshold value Vthdrv of the drive transistor DRT and becomes the voltage VINI−Vthdrv.

Consequently, the voltage of the node A (n) is the low voltage (VSS), the voltage of the node B (n) is the initialization voltage VINI, the voltage of the node C (n) is VINI−Vthdrv, the voltage of the node D (n) is the voltage VDD, and the voltage of the node E (n) is the image signal VSIG which is an analog voltage.

In the fifth period T5 following the 51st period T51, the scanning signal SG (n) is supplied a low voltage from the high voltage. Consequently, the initialization transistor IST and the select transistor SST are in a non-conductive state.

Consequently, the voltage of the node A (n) is the low voltage (VSS), the initialization voltage VINI of the node B (n) is held, the voltage of the node C (n) is VINI−Vthdrv, the voltage of the node D (n) is the voltage VDD, and the voltage of the node E (n) holds the image signal VSIG which is an analog voltage.

<2-3-3. Sixth Period T6>

In an embodiment, the sixth period T6 is referred to as a light-emitting period. A driving method of the sixth period T6 will be described with reference to FIG. 10 and FIG. 13.

The scanning signal SG (n) continues to be supplied with a low voltage, the bias control signal line 422 continues to be supplied with the bias voltage VBIAS, the data control signal DG (n) continues to be supplied with a high voltage from a low voltage, the light emission control signal BG (n) continues to be supplied with a high voltage, and the reset signal RG (n) continues to be supplied with a low voltage.

Therefore, the initialization transistor IST, the select transistor SST, and the reset transistor RST are in a non-conductive state, and the light emission control transistor BCT and the drive transistor DRT are in a conductive state.

The data control signal DG (n) is supplied with a high voltage from a low voltage, so that the voltage at the node A (n) gradually increases from the low voltage (VSS) to a high voltage (VDD). Consequently, the switching transistor SW2 becomes a conductive state. When the voltage of the node A (n) becomes a voltage that is reduced by the threshold Vthsw1 of the switching transistor SW1 from the bias voltage VBIAS, the node A (n) is in a floating state and the switching transistor SW2 maintains a conductive state.

When the switching transistor SW2 maintains the conductive state, the voltage at the node B (n) gradually increases from the initialization voltage VINI to the image signal VSIG. The node A (n) is in a floating state and the voltage at the node B (n) gradually increases from the initialization voltage VINI to the image signal VSIG, so that the voltage at the node A (n) gradually increases from the high voltage (VDD) due to capacitive coupling with the bootstrap capacitance Cbst. For example, the voltage at the node A (n) becomes a voltage dVC greater than the high voltage (VDD).

Consequently, the switching transistor SW2 transitions to a sufficient conductive state and the voltage at the node B (n) and the voltage at the node E (n) both become the image signal VSIG which is an analog voltage. That is, the pixel 170B can emit light at a voltage corresponding to the image signal VSIG.

In the conventional display device, the imaging signal supplied to the gate electrode of the drive transistor DRT may be lowered by the threshold value of the transistor electrically connected to the gate electrode of the drive transistor DRT. Therefore, an image signal corresponding to the desired voltage cannot be supplied to the gate electrode of the drive transistor DRT, and the pixel does not emit light according to the desired voltage, so the display quality of the display device may deteriorate. On the other hand, as described above, the display device 10B is provided with the bootstrap circuit 114, so that the switching transistor SW2 can be transitioned to a sufficient conduction state. Consequently, since the display device 10B can supply an image signal corresponding to the desired voltage to the gate electrode of the drive transistor DRT, the pixel emits light according to the desired voltage, and it is possible to suppress a decrease in the display quality of display device.

3. Third Embodiment

Figure 14:
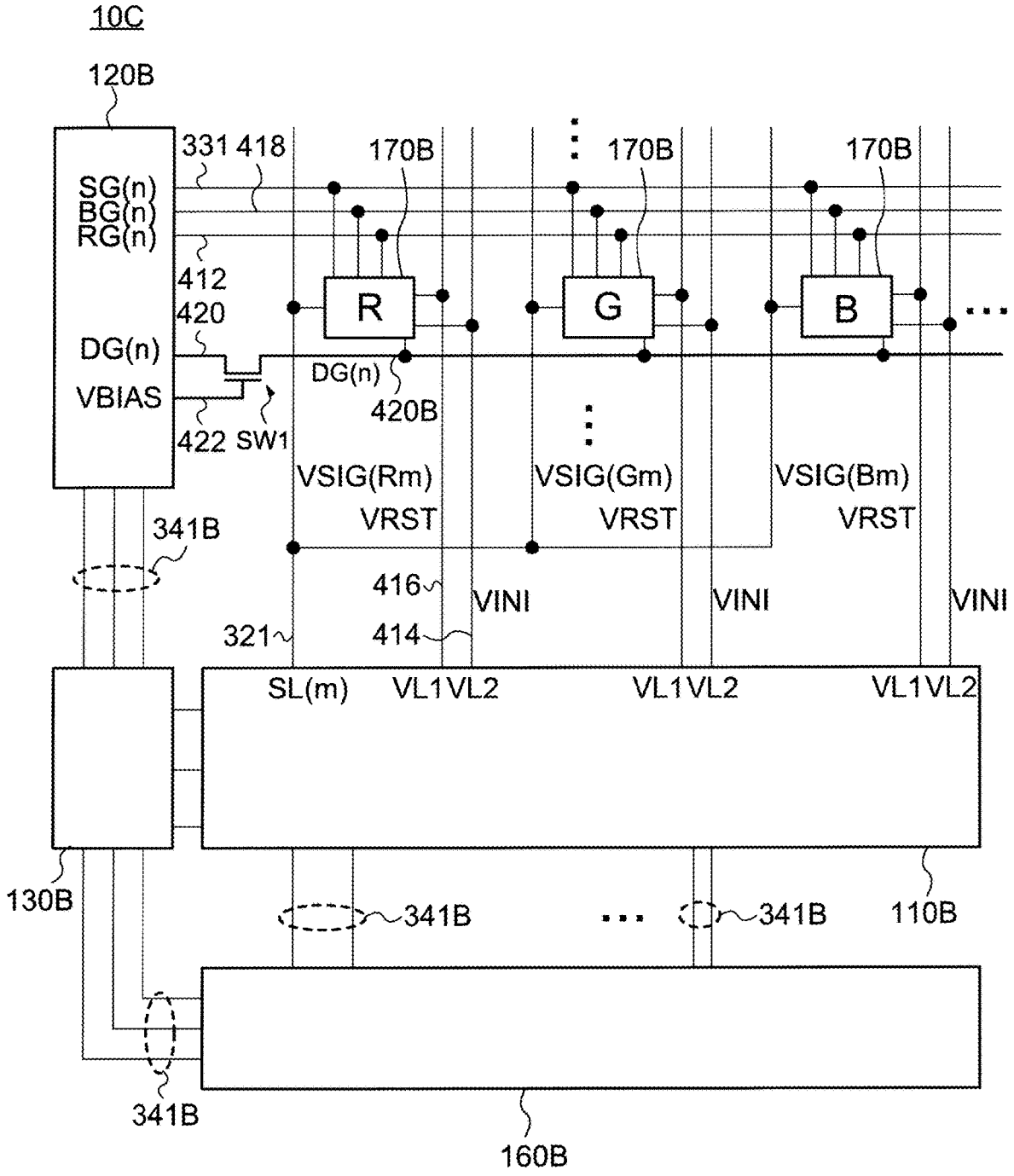
FIG. 14 is a schematic diagram showing a configuration of a display device according to an embodiment.
Figure 15:
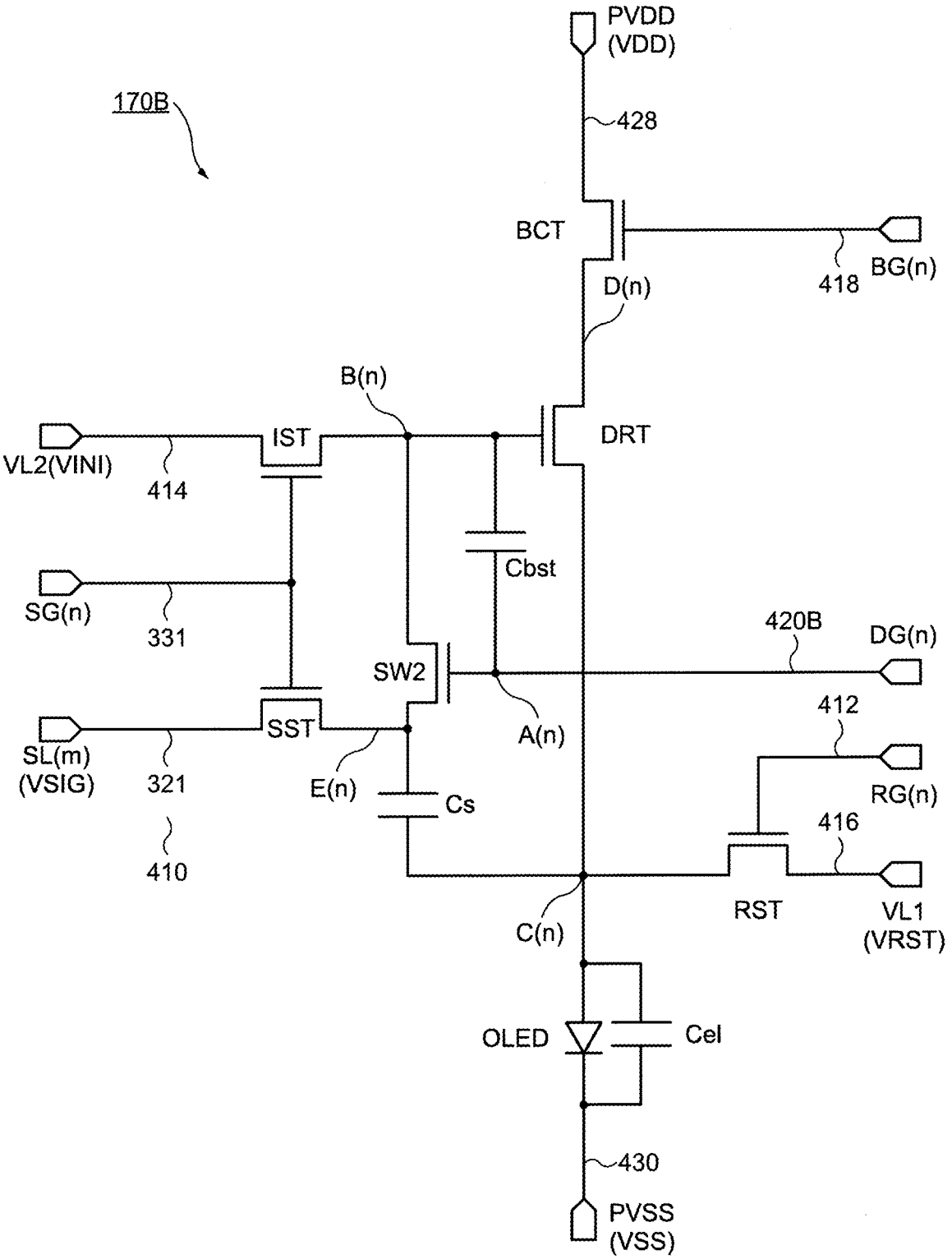
FIG. 15 is a circuit diagram showing a circuit configuration of a pixel according to an embodiment.

In the third embodiment, an example in which the bootstrap circuit 114B is applied to the pixel 170B of the EL display device 10B will be described with reference to FIG. 14 to FIG. 15. Relative to the second embodiment, in the third embodiment, the switching transistor SW1 is not provided for each pixel 170B, but one switching transistor SW1 is provided for the data control signal line 420. In the third embodiment, since the configuration other than the configuration of providing one switching transistor SW1 to the data control signal line 420 is the same as the second embodiment, a description thereof will be omitted. The display device 10B shown in FIG. 14 to FIG. 15 is merely an example, and the display device 10B is not limited to the example shown in FIG. 14 to FIG. 15. The same or similar configurations as those in FIG. 1 to FIG. 13 will be described as necessary.

As shown in FIG. 14, one switching transistor SW1 is provided between the data control signal line 420 and a data control signal line 420B. the gate electrode of the switching transistor SW1 is electrically connected to the bias control signal line 422 as in the second embodiment. That is, one switching transistor SW1 is shared by the plurality of pixels 170B.

When the switching transistor SW1 is in a conductive state, the data control signal DG (n) is supplied from the data control signal line 420 to the data control signal line 420B. As shown in FIG. 15, the data control signal DG (n) supplied to the data control signal line 420B is supplied to the gate electrode of the switching transistor SW2.

In the third embodiment, the bootstrap circuit is configured using the switching transistor SW1 shown in FIG. 14, the switching transistor SW2 and the bootstrap capacitance Cbst shown in FIG. 15. A driving method similar to the driving method described in the first embodiment or the second embodiment can be used as a driving method of the bootstrap circuit.

The display device circuit 10B according to the third embodiment can use the bootstrap circuit 114. As a result, it is possible to obtain the same effects as those in the first embodiment and the second embodiment.

What is claimed is:

1. A bootstrap circuit comprising:

a first transistor including a gate electrode, a first electrode and a second electrode;

a capacitor electrically connected between the gate electrode and the second electrode; and a second transistor electrically connected to the gate electrode, wherein in a first period when the bootstrap circuit is driven, the second transistor is turned on and the gate electrode is supplied with a first analog voltage, the first transistor is turned on, and the second electrode is supplied with a precharge voltage smaller than the first analog voltage from the first electrode, in a second period when the bootstrap circuit is driven, the second transistor is turned off and the first electrode of the first transistor is supplied with a second analog voltage, the capacitor supplying a third analog voltage to the gate electrode in response to the first analog voltage and the second analog voltage, and the second electrode is supplied with the second analog voltage from the first electrode.

2. The bootstrap circuit according to claim 1, wherein in a third period after the second period, the second transistor is turned on, the gate electrode is supplied with a fourth analog voltage smaller than the first analog voltage, and the capacitor holds the second analog voltage supplied to the second electrode.

3. The bootstrap circuit according to claim 1, wherein the first transistor includes a first semiconductor film, and the first semiconductor film includes an oxide semiconductor.

4. The bootstrap circuit according to claim 1, wherein the second transistor includes a second semiconductor film, and the second semiconductor film includes an oxide semiconductor.

5. A display device comprising:

a plurality of pixels;

a bootstrap circuit including a first transistor including a gate electrode, a first electrode and a second electrode, a capacitor electrically connected between the gate electrode and the second electrode, and a second transistor electrically connected to the gate electrode; and a control circuit;

wherein the bootstrap circuit is configured to electrically connect the second electrode to one of the plurality of pixels, in a first period when the bootstrap circuit is driven, the control circuit supplies a first analog voltage to the second transistor, supplies a precharge voltage smaller than a first analog voltage to the first electrode, the second transistor is turned on, the gate electrode is supplied with the first analog voltage, the first transistor is turned on, the gate electrode is supplied with the first analog voltage, the second electrode is supplied with a precharge voltage smaller than the first analog voltage from the first electrode, in a second period after the first period when the bootstrap circuit is driven, the second transistor is turned off, the first electrode is supplied with a second analog voltage, the capacitor supplying a third analog voltage to the gate electrode in response to the first analog voltage and the second analog voltage, and the first transistor supplies the second analog voltage from the first electrode to the second electrode.

6. The display device according to claim 5, wherein in a third period after the second period, the control circuit supplies a fourth analog voltage smaller than the first analog voltage to the gate electrode, the second transistor is turned on and the gate electrode is supplied with the fourth voltage, the first transistor is turned on, and the capacitor holds the second analog voltage supplied to the second electrode.

7. The display device according to claim 5, wherein the first transistor includes a first semiconductor film, and the first semiconductor film includes an oxide semiconductor.

8. The display device according to claim 7, wherein the second transistor includes a second semiconductor film, and the second semiconductor film is formed in the same layer of the first semiconductor layer including an oxide semiconductor.

9. The display device according to claim 5, further comprising:

a plurality of the bootstrap circuit;

wherein the plurality of the bootstrap circuits includes a first bootstrap circuit and a second bootstrap circuit, the plurality of the pixels includes a first pixel and a second pixel different from the first pixel, the first bootstrap circuit is electrically connected to the first pixel, and the second circuit bootstrap is electrically connected to the first pixel.

10. The display device according to claim 9, wherein the first electrode of the first bootstrap circuit electrically connects to the first electrode of the second bootstrap circuit and the control circuit, the control circuit is configured to control at different timings the first period, the second period and the third period corresponding to an operation of the first bootstrap circuit, and the first period, the second period and the third period corresponding to the operation of the second bootstrap circuit.

11. The display device according to claim 9, wherein the first pixel displays a different color than the second pixel.

12. The display device according to claim 11, wherein the first pixel displays one of the colors red, green, or blue, and the second pixel is configured to display a different color than the first pixel.

* * * * *